US007461594B2

(12) United States Patent
Goto

(10) Patent No.: US 7,461,594 B2
(45) **Date of Patent: *Dec. 9, 2008**

(54) PRINTING PLATE MATERIAL, PRINTING PLATE MANUFACTURING METHOD, AND PRINTING METHOD

(75) Inventor: Kiyoshi Goto, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/332,583

(22) Filed: Jan. 13, 2006

(65) Prior Publication Data

US 2006/0207454 A1 Sep. 21, 2006

(30) Foreign Application Priority Data

Jan. 18, 2005 (JP) ..... 2005-010102
Mar. 1, 2005 (JP) ..... 2005-055601

(51) Int. Cl.
*B41N 1/00* (2006.01)

(52) U.S. Cl. ..... 101/457; 101/451; 101/453; 101/467; 101/484; 430/302

(58) Field of Classification Search ..... 101/463.1, 101/457

See application file for complete search history.

(56) References Cited

U.S. PATENT DOCUMENTS

| | | | | |
|---|---|---|---|---|
| 6,110,085 | A * | 8/2000 | Schloemer et al. | 492/59 |
| 2002/0056392 | A1 * | 5/2002 | Sameit et al. | 101/484 |
| 2005/0061183 | A1 * | 3/2005 | Maehashi | 101/453 |
| 2005/0194087 | A1 * | 9/2005 | Rossini et al. | 156/190 |

* cited by examiner

*Primary Examiner*—Leslie J. Evanisko
*Assistant Examiner*—Joshua Zimmerman
(74) *Attorney, Agent, or Firm*—Lucas & Mercanti, LLP

(57) ABSTRACT

A printing plate material having an aluminum support on which an image forming layer is provided, wherein a wireless IC tag is provided on a part of the printing plate material.

12 Claims, 9 Drawing Sheets

PRINTING PLATE MATERIAL, PRINTING PLATE MANUFACTURING METHOD, AND PRINTING METHOD

This application is based on Japanese Patent Application Nos. 2005-010102 filed on Jan. 18, 2005, and 2005-055601 filed on Mar. 1, 2005, in Japanese Patent Office, the entire content of which is hereby incorporated by reference.

BACKGROUND OF THE INVENTION

The present invention relates to a printing plate material for a computer-to-plate (hereinafter referred to as CTP) system having an aluminum support, a plate-making method and a printing method.

In recent years, in manufacturing technologies of printing plates for offset printing, there have been developed CTPs for recording digital data of images directly on a photosensitive printing plate with a laser light source, and they have been put to practical use.

In the field of printing where relatively long plate life is required among the aforesaid technologies, there is known a method to use a printing plate material having thereon an aluminum plate representing a support and an image forming layer provided on the aluminum plate.

As the aluminum plate, there are generally used those subjected to surface-roughening treatment and anodic treatment.

On the other hand, there is a demand for a printing plate material that requires no photographic processing by a processing solution containing specific chemicals (for example, an alkali, an acid and a solvent), and can be applied to conventional printing machines, and for example, there are known printing plate materials for a dry CTP method such as a printing plate material of a phase changing type that does not require photographic processing at all and a printing plate material in which photographic processing is conducted in the initial stage of printing on the printing machine and does not require a development process in particular.

As those used for a dry CTP method, there are given, for example, printing plate materials of an abrasion type described in TOKUKAIHEI Nos. 8-507727, 6-186750, 6-199064, 7-314934, 10-58636 and 10-244773, and those of a type in which a thermosensitive image forming layer is provided on a base material and an image portion is formed on a hydrophilic layer through imagewise heat generation by laser exposure (for example, Patent Document 1, Patent Document 2 and Patent Document 3).

The printing plate material having a thermosensitive image forming layer for forming an image portion where a laser beam is converted into heat on a hydrophilic layer is suitable for forming a high-definition images, because sharp dots are formed.

As the printing plate material for CTP having relatively high plate life, there are known printing plate materials each having therein a photopolymerization type image forming layer described in, for example, TOKUKAI Nos. 2002-107916 and 2003-76010.

Since halftones are recorded with 100-300 lines of laser each being converged to 5-30 μm in CTP in general, an individual halftone is recorded with plural laser beams as a rule.

In a principle, therefore, it is possible to change gradation reproduction for printing optionally, by changing exposure pattern and output of laser exposure, thus, in conventional CPT printing, conditions of a plate-making apparatus are used after initial setting, so that desired printed matters may be obtained.

However, it has been necessary to prepare an exclusive plate-making apparatus respectively and to change condition setting manually, when using plural types and sizes of printing plate materials, because it is necessary to set a plate-making apparatus and plate-making conditions depending on types and sizes of printing plate materials for CTP.

Even in the case of printing by the use of printing plate materials for CTP, it has been necessary for an operator to set an individual printing condition depending on a type of printing plate material in the past, because optimum printing conditions vary depending on printing materials such as a type of ink, dampening water and printing paper in addition to types of printing plate materials and image patterns.

In particular, in the case of in-flight processing type printing plate materials representing processless printing plate materials, it is necessary to set optimum conditions constantly for keeping fixed printing quality, because exposure conditions and water-ink balance conditions in the initial printing are affected greatly by in-flight developability.

However, even when the conditions were set individually, it was impossible to avoid occurrence of a width of fluctuation to a certain extent in printing quality, because of actual fluctuations of manufacturing lot of printing plate materials, aging performance, efficiency by working environment such as temperature and humidity, or of output of exposure light source and in printing conditions.

Further, in the past, it was necessary to control developing conditions and printing conditions based on information of exposure conditions and developing conditions recorded on, for example, a sheet of paper, and it was necessary to control plate-making and printing manually, which was extremely time-consuming and errors of control were easily caused.

On the other hand, in recent years, development of RFID (wireless IC tag) has been advanced in the field of non-contact IC card.

Owing to the tendency toward a low price and downsizing of (wireless IC tag), there are known practical use as tools for production control and stock control of commodities including a field of cards having a high added value (for example, see Patent Document 4).

(Patent Document 1) TOKUKAI No. 2001-96710
(Patent Document 2) TOKUKAI No. 2001-138652
(Patent Document 3) TOKUKAI No. 2001-113848
(Patent Document 4) TOKUKAI No. 2003-67838

SUMMARY OF THE INVENTION

Objects of the invention are to provide a printing plate material, a plate-making method and a printing method, wherein a plate life is long, a fluctuation of printing quality is reduced, and printed matters having stable quality can be obtained constantly.

The objects of the invention stated above can be attained by the following items.

(Item 1)

A printing plate material having an aluminum support on which an image forming layer is provided, wherein a wireless IC tag is provided on a part of the printing plate material.

(Item 2)

The printing plate material described in Item 1, wherein the wireless IC tag is installed on the printing plate material through an insulating object.

(Item 3)

The printing plate material described in Item 1 or Item 2, wherein the wireless IC tag is on the same plane as that on which the printing plate material is.

(Item 4)

The printing plate material described in any one of Item 1-Item 3, wherein the printing plate material is rectangular, and the wireless IC tag is in the rectangle.

(Item 5)

The printing plate material described in Item 1, wherein the wireless IC tag is pasted on the aluminum support by means of an insulating adhesive layer.

(Item 6)

The printing plate material described in Item 5, wherein the wireless IC tag pasted on the aluminum support by means of an insulating adhesive layer is further covered by an insulating object.

(Item 7)

The printing plate material described in any one of Item 1-Item 6, wherein the wireless IC tag holds data of information concerning the printing plate material.

(Item 8)

The printing plate material described in Item 7, wherein the information concerning the printing plate material is information about manufacturing, information about performance or information about plate-making processing conditions.

(Item 9)

A plate-making method for making the printing plate material described in Item 7 or Item 8, wherein imagewise exposure is carried out by controlling imagewise exposure conditions based on data of information concerning the printing plate material.

(Item 10)

The plate-making method described in Item 9, wherein information concerning the printing plate material is information of sensitiveness.

(Item 11)

A plate-making method for making the printing plate material described in Item 7 or Item 8, wherein photographic processing is carried out by controlling photographic processing conditions based on data of information concerning the printing plate material.

(Item 12)

The plate-making method according to Item 11, wherein information concerning the printing plate material includes aging information after manufacturing the printing plate material and information of exposure conditions.

(Item 13)

A printing method for printing by using a printing plate made by conducting imagewise exposure and photographic processing on the printing plate material described in Item 7 or Item 8, wherein printing conditions are controlled based on data of information concerning the printing plate material for conducting printing.

(Item 14)

The printing method according to Item 13, wherein information concerning the printing plate material includes information of exposure conditions and information of photographic processing conditions.

(Item 15)

A packaging object for packaging an aggregate of lithographic printing plate materials, wherein a wireless IC tag is installed.

(Item 16)

An aggregate of lithographic printing plate materials wherein the aggregate is packaged by the packaging object for packaging an aggregate of lithographic printing plate materials described in Item 15.

(Item 17)

A plate-making and printing method for conducting plate-making and printing by using the aggregate of lithographic printing plate materials described in Item 16, wherein the wireless IC tag holds data of information concerning the lithographic printing plate materials, and plate-making conditions for the plate-making or printing conditions for the printing are established by the use of that data.

Owing to the items stated above, it is possible to provide a printing plate material, a plate-making method and a printing method wherein a plate life is long, fluctuations in quality of printing are reduced and printed matters having stable quality can be obtained constantly, in the printing employing printing plate materials for CTP.

BRIEF DESCRIPTION OF THE INVENTION

DETAILED DESCRIPTION OF THE PREFERRED EMBODIMENT

Figure 1:
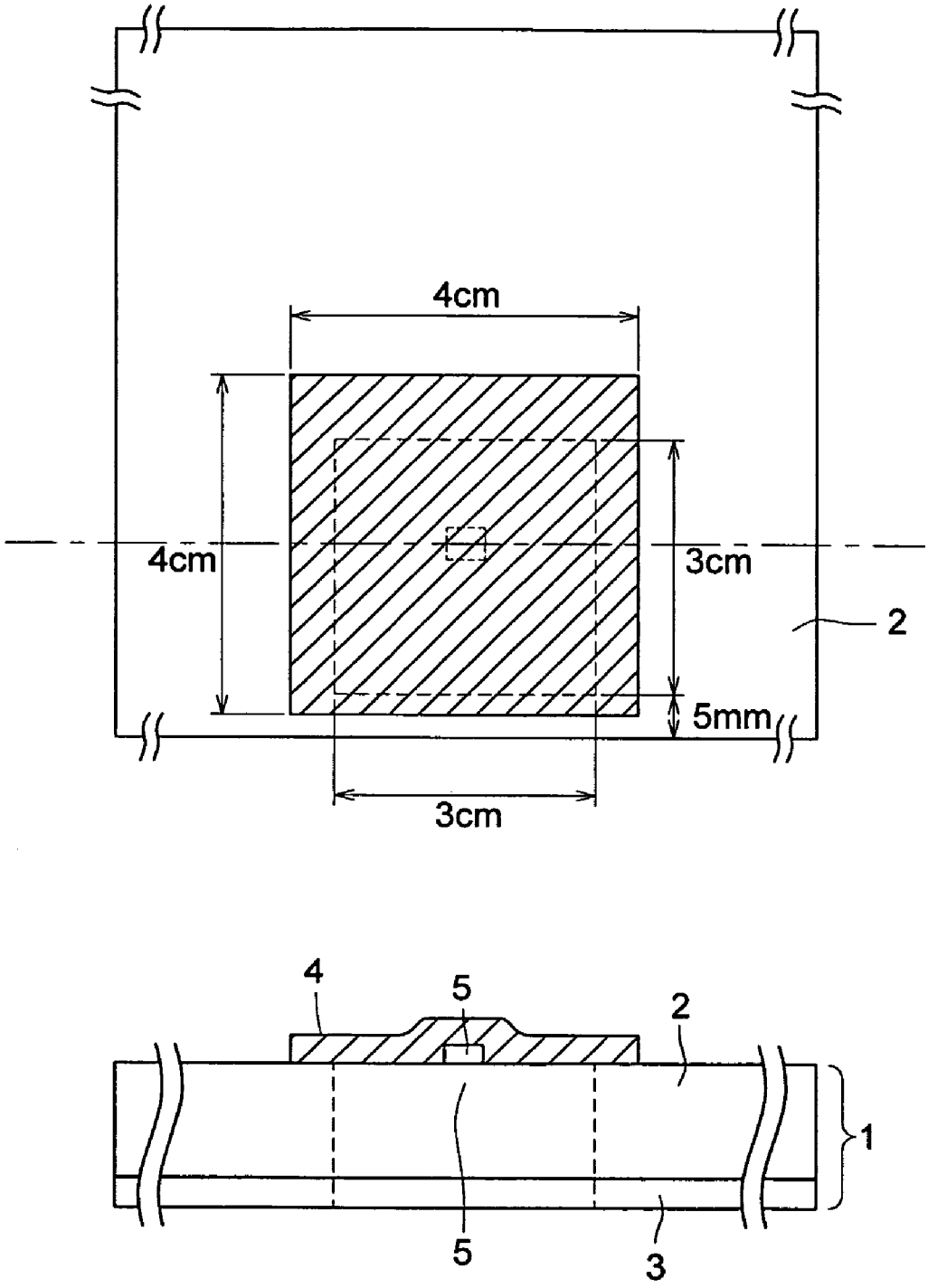
FIG. 1 is a schematic diagram for a plan view and a cross-sectional view showing an example of a printing plate material of the invention.

The invention will be explained in detail as follows.

The invention is characterized in a printing plate material having an image forming layer on an aluminum support to have a wireless IC tag that is provided on a part of the printing plate material.

In the invention, by providing a wireless IC tag on a printing plate material, it is possible to obtain a printing plate material which is a printing plate material for CTP wherein a plate life is long, fluctuations in printing quality are reduced and printed matters having stable quality can be obtained constantly.

A printing plate material of the invention has, on a surface of one side of an aluminum support, an image forming layer where a printing plate can be made by digital devices such as a laser, a thermal head and an ink-jet head.

Among them, effects of the invention can be exhibited remarkably on the printing plate material used especially for laser exposure.

A wireless IC tag (RF-ID) used in the invention is one that houses therein at least a semiconductor memory and a coil (antenna) for two-way transmission, and is constructed so that it can communicate information with an outer exclusive reader/writer on a noncontact basis.

Though the wireless IC tag is provided on a part of the printing plate material, it is preferable that it is provided on a portion that does not affect on printing substantially, and preferable is a portion in the vicinity of the end portion of the printing plate material.

As a configuration for the wireless IC tag to be installed on the printing plate material, there is given a configuration where the wireless IC tag is pasted on the surface on the side of the printing plate material having an image forming layer or on the surface on the opposite side thereof, for example, or a configuration wherein the wireless IC tag is installed on the same plane as that on which the aluminum support is provided.

As a method to install the wireless IC tag in the invention, it is a preferable configuration that the wireless IC tag is installed on the printing plate material through an insulating object.

After receiving a radio wave coming from a reader/writer with an antenna, the wireless IC tag generates electric power with electromotive force by electromagnetic induction. This electric power operates an electric circuit inside the wireless IC tag, and control data are communicated with a reader/writer. Through this communication, information from a reader/writer is received to be stored in a semiconductor memory, or information stored is sent to the reader/writer.

As stated above, the wireless IC tag can be used semipermanently because it requires no power supply, but, for generating electric power through electromagnetic induction, it is important to separate the wireless IC tag electrically from other electric conductors with an insulating object.

For this reason, when installing the wireless IC tag on the aluminum support of the printing plate material, for example, it is necessary to interpose an insulating object between the aluminum support and the wireless IC tag.

As this configuration, there is considered one wherein the wireless IC tag is installed on the aluminum support by means of insulating adhesive agents, or one wherein an insulating object such as an insulating sheet or a two-sided adhesive and insulating tape is provided on the aluminum support, and the wireless IC tag is provided on that insulating object.

In the invention, a configuration wherein a wireless IC tag and a printing plate material are on the same plane is preferable from the viewpoint of easy communication of information.

In the invention, a configuration wherein a wireless IC tag and an insulating object are on the same plane as that for the printing plate material is preferable from the viewpoint of easy handling.

Being on the same plane as that for the printing plate material means the existence within a range surrounded by a surface on one side of the printing plate material plus a surface extended from the aforesaid surface, and by a surface on the other side plus its extended surface, and in other words, it means that the printing plate material does not have a protrusion of the wireless IC tag at least on its obverse side and on its reverse side.

For arranging the wireless IC tag to be on the same plane as that for the printing plate material, it is possible to cut off a part of the printing plate material, and thereby to fix the wireless IC tag at the cutout portion on the printing plate material through an insulating object.

As a method for the fixing, there is given a method, for example, wherein an insulating object is fixed on the circumference of the wireless IC tag, and this insulating object is fixed on the cutout portion.

As a form of the insulating object, there are given a plate-shaped object that is hollowed out so that the wireless IC tag may be embedded therein, and a net-shaped object that is constructed so that the wireless IC tag may be inserted therein.

It is preferable that the printing plate material of the invention is in a rectangular shape.

The wireless IC tag may be installed to be adjacent to this rectangle, and preferable is that the wireless IC tag is arranged within a range of the rectangle, namely, within this rectangle.

As a position for the wireless IC tag within the rectangle to be arranged, a position near the end portion of the rectangle as stated above is preferable.

Each of FIGS. 1-7 shows an example of the embodiment of the printing plate material of the invention on which the wireless IC tag is installed.

Each of FIGS. 1-7 shows a schematic diagram for a plan view and a cross-sectional view of a printing plate material.

Each of FIGS. 1, 2, 3, 4 and 7 is an illustration of an example of the wireless IC tag which is on the same plane as that for the printing plate material.

In FIG. 1, wireless IC tag 5 is pasted on aluminum support 2 through insulating adhesive agents, and insulating object 4 is further pasted on the wireless IC tag 5. Owing to this configuration, the wireless IC tag 5 is isolated electrically from the circumstance, and is protected from the outside by the insulating object 4 that functions as a protective sheet.

Figure 2:
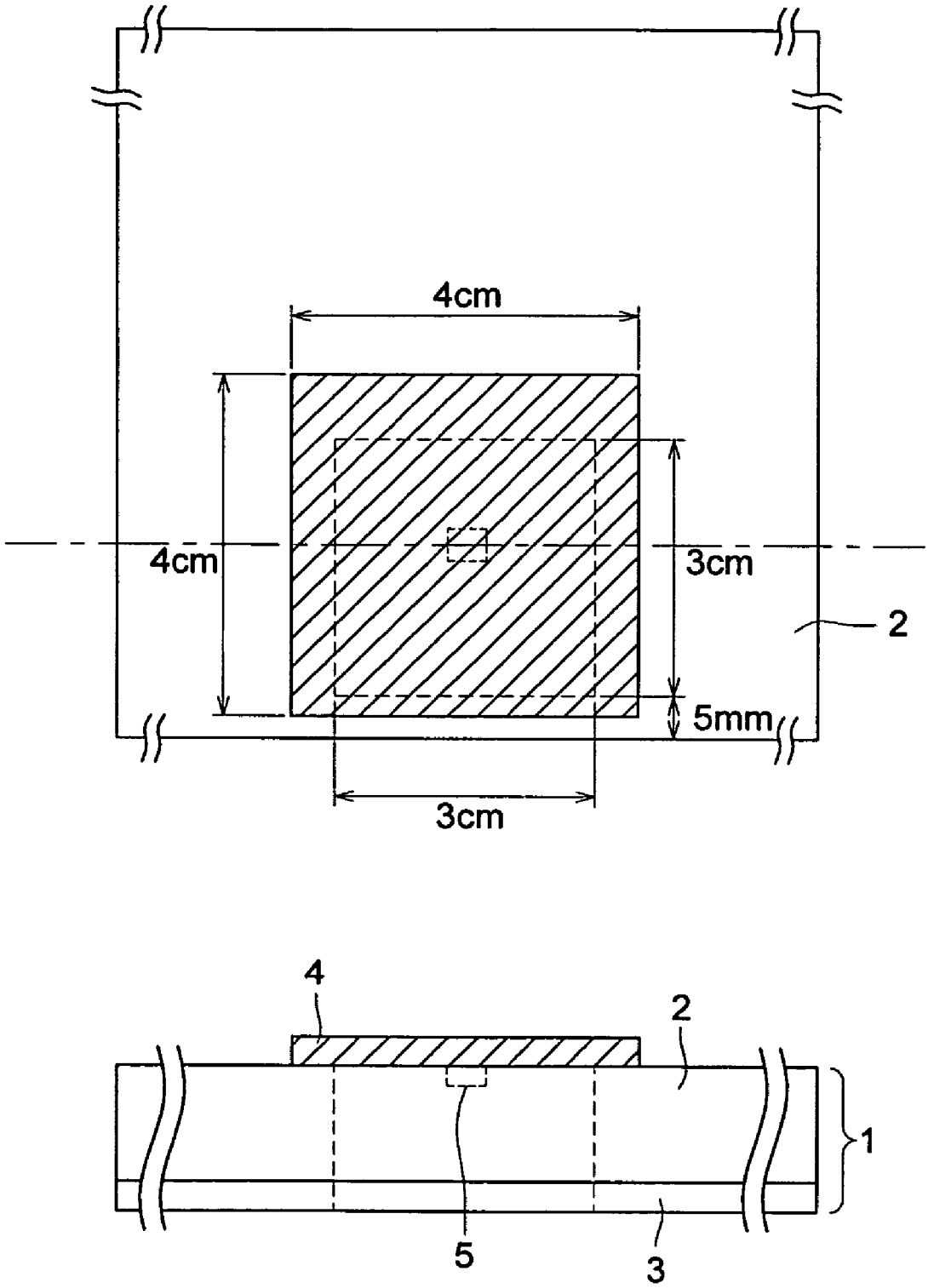
FIG. 2 is a schematic diagram for a plan view and a cross-sectional view showing an example of a printing plate material of the invention.
Figure 3:
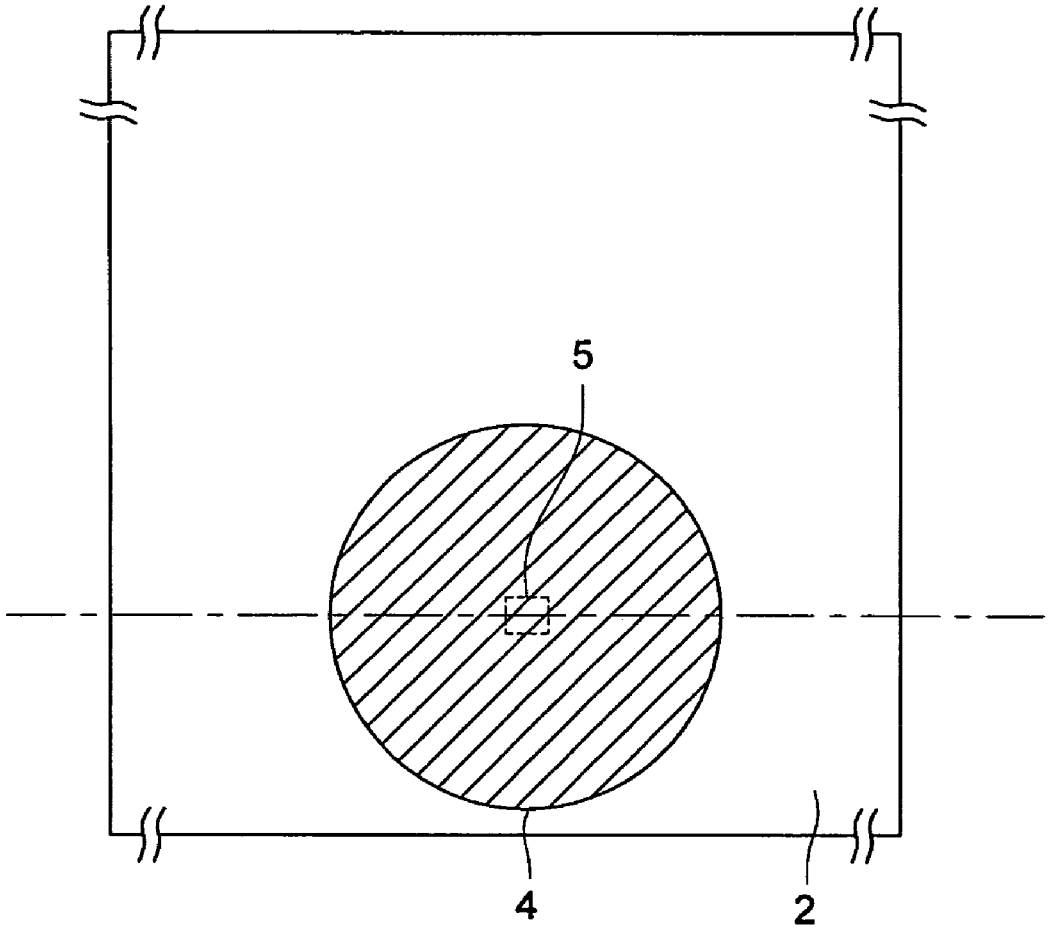
FIG. 3 is a schematic diagram for a plan view and a cross-sectional view showing an example of a printing plate material of the invention.
Figure 3:
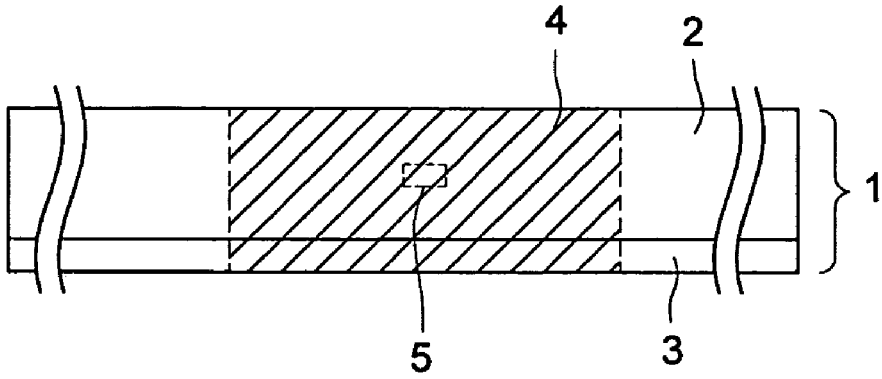

In each of FIGS. 2 and 3, a part of rectangular printing plate material 1 having aluminum support 2 and image forming layer 3 is hollowed out, and wireless IC tag 5 is fixed on the hollowed out portion through insulating object 4. Owing to this, the wireless IC tag is installed to be on the same plane as that for the aluminum support.

Figure 4:
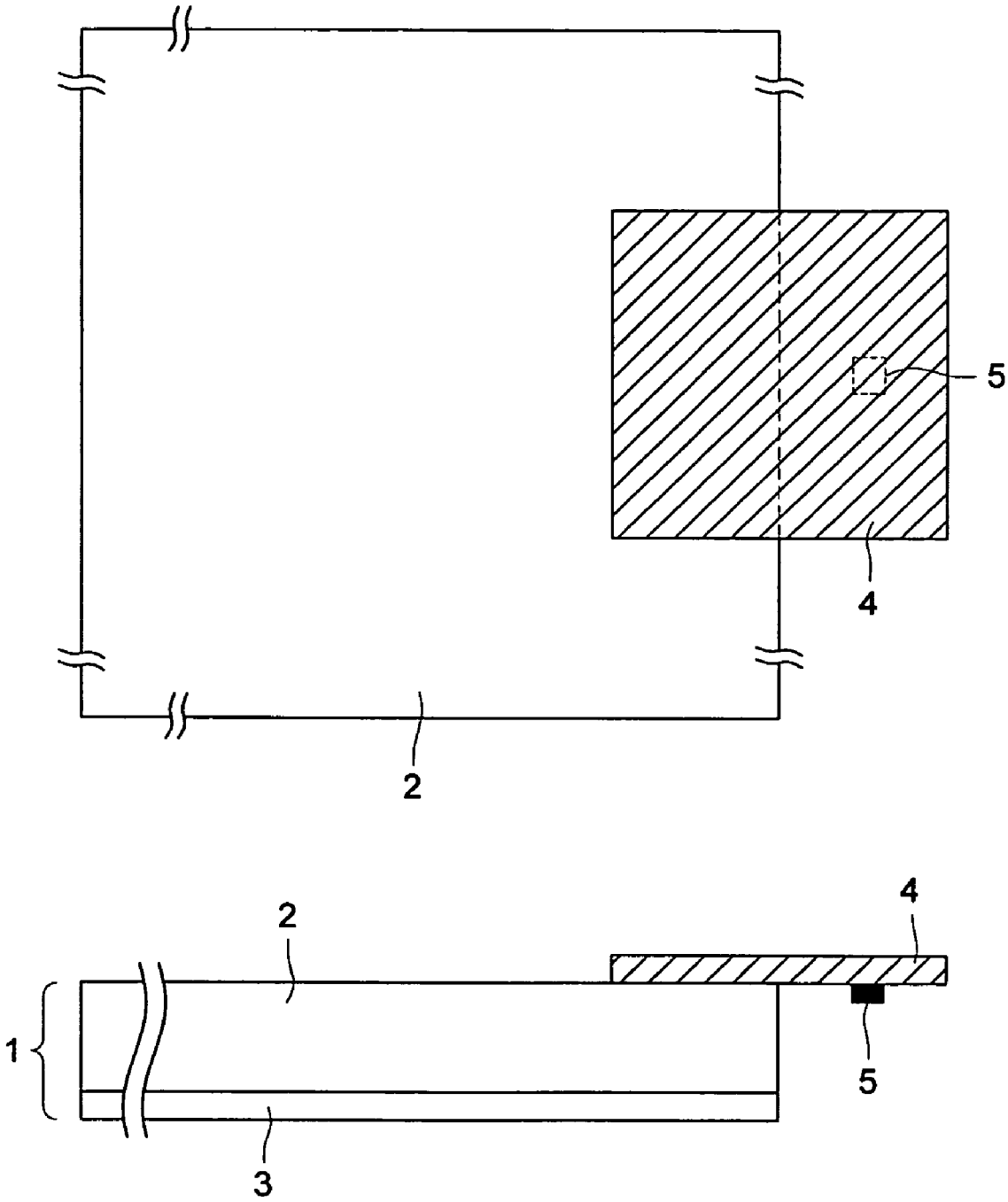
FIG. 4 is a schematic diagram for a plan view and a cross-sectional view showing an example of a printing plate material of the invention.

In FIG. 4, the wireless IC tag 5 is fixed on the same plane as that for the printing plate material, although the position of the fixing is out of a rectangle of the printing plate material.

Figure 7:
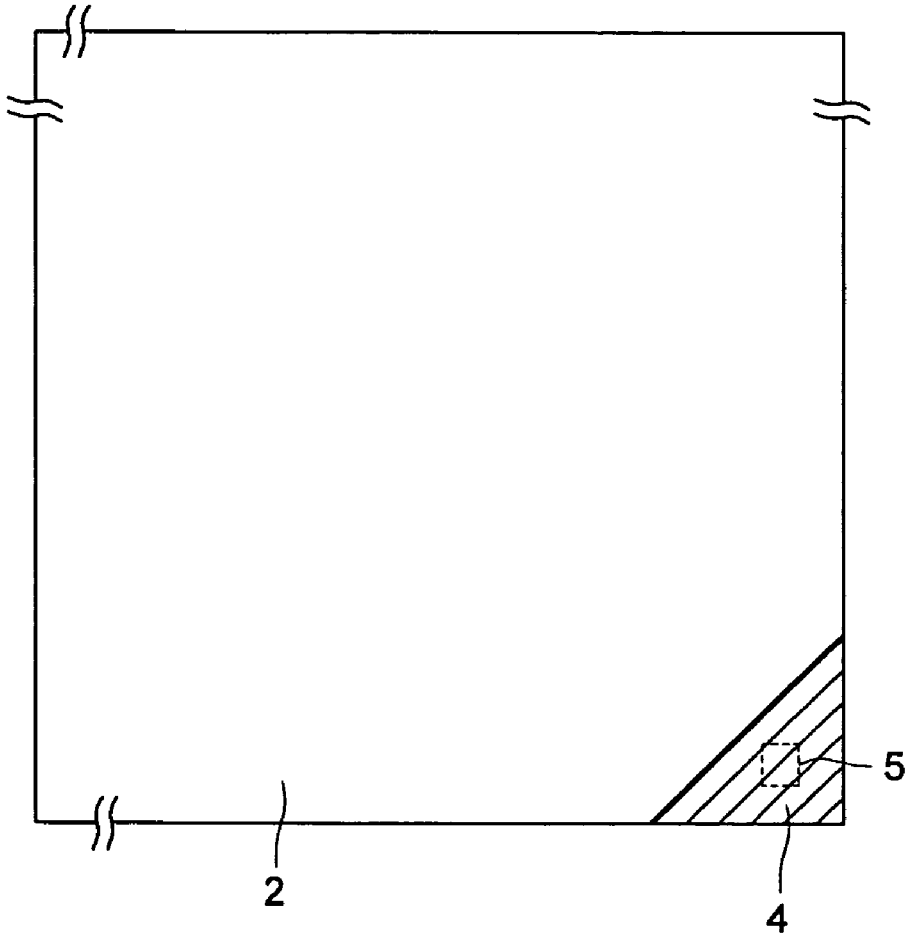
FIG. 7 is a schematic diagram for a plan view and a cross-sectional view showing an example of a printing plate material of the invention.
Figure 7:
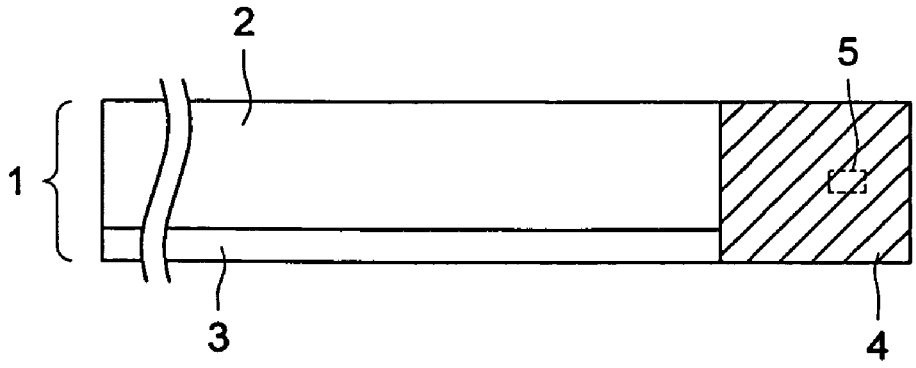

In FIG. 7, a part of the rectangular printing plate material is cut out, and insulating object 4 in which wireless IC tag 5 is embedded is fixed on the cut out portion.

Figure 5:
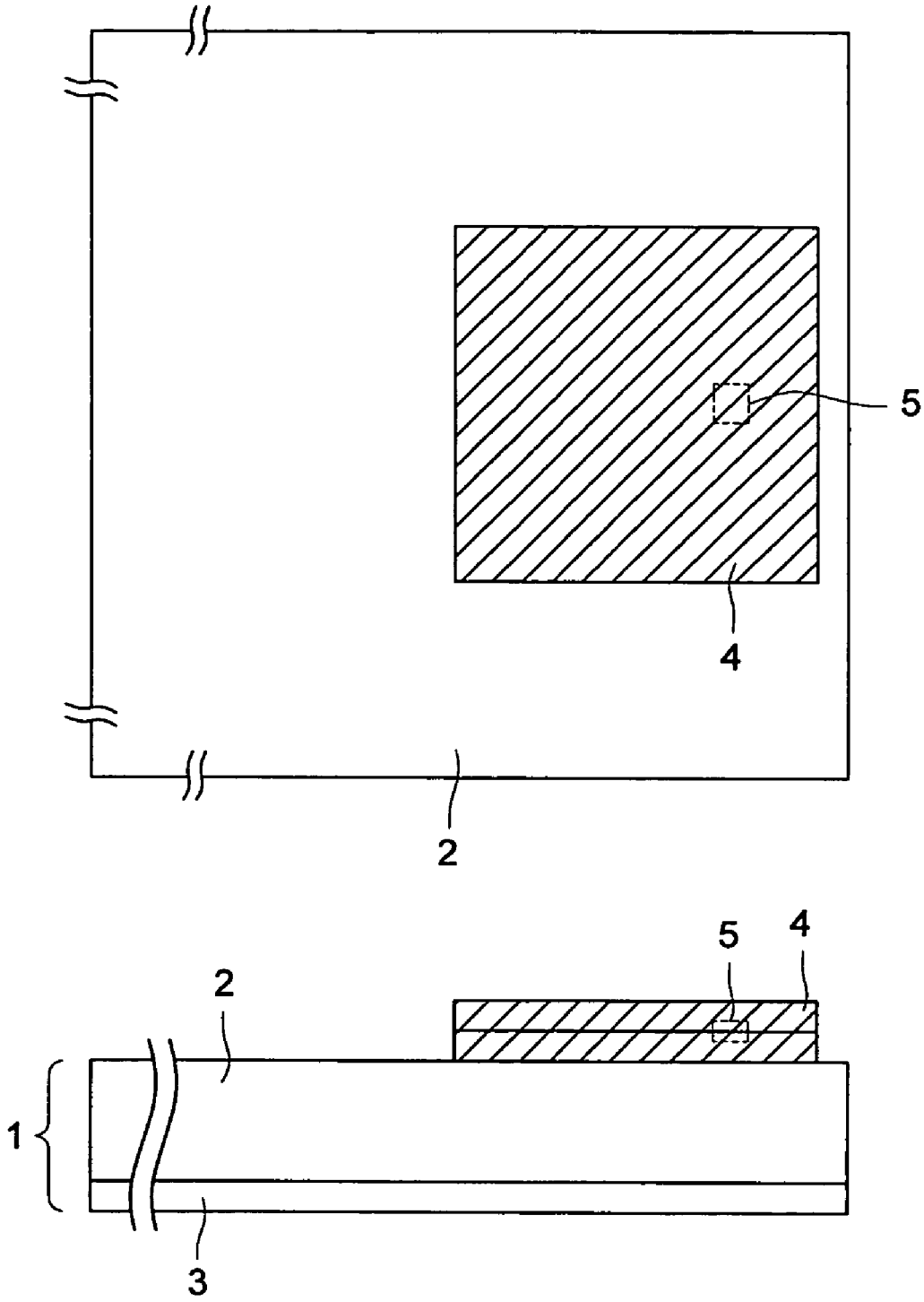
FIG. 5 is a schematic diagram for a plan view and a cross-sectional view showing an example of a printing plate material of the invention.
Figure 6:
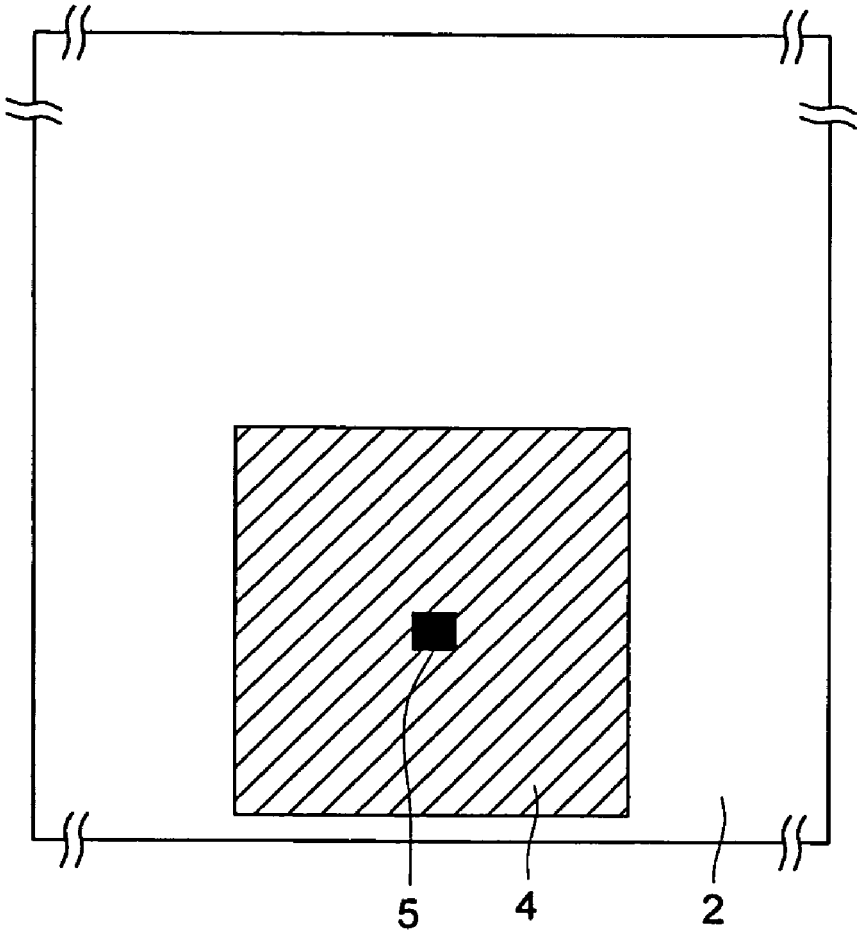
FIG. 6 is a schematic diagram for a plan view and a cross-sectional view showing an example of a printing plate material of the invention.
Figure 6:
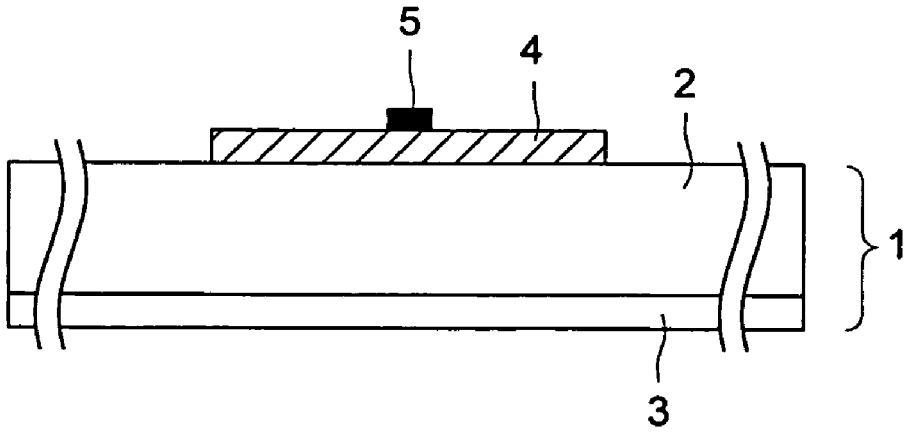

Each of FIGS. 5 and 6 is one illustrating another example of the printing plate material on which the wireless IC tag is installed.

The wireless IC tag relating to the invention may also be pasted on the insulating object processed, for example, to be seal-shaped.

As a specific example of a seal-shaped wireless IC tag, there is given Contactless Smart Label made by Vanskee Co.

When using a wireless IC tag in the aforesaid seal shape, its thickness is preferably 0.1 mm or less, and more preferable is 0.07 mm or less.

Though the smaller area of a wireless IC tag seal is more preferable, it is necessary to secure an area for an antenna for making sure communication possible.

For pasting a wireless IC tag seal on the printing plate material, a rectangular wireless IC tag seal is preferable, and a length of a shorter side is 25 mm or less, and preferable is 15 mm or less and more preferable is 10 mm or less.

It is also a preferable configuration that the wireless IC tag seal adheres to the reverse side of the end portion of the printing plate material through an insulating object.

As a wireless IC tag to be pasted that is used when pasting on the reverse side, there is given (Accuwave, OMH-4230) manufactured by DAI NIPPON PRINTING CO., LTD.

As an insulating adhesive agent relating to the invention, epoxy-based adhesive agents can be used.

As an insulating object relating to the invention, 50-200 μm-thick PET (polyethylene terephthalate) film, PP (polypropylene) film, PE (polyethylene) film and synthetic rubber sheet, for example, are used preferably.

A printing plate material of the invention is one on which a wireless IC tag is pasted on a part thereof, and it can communicate information with a reader/writer installed in a plate-making equipment, owing to the wireless IC tag installed therein, and it can communicate information with a reader/writer installed in a printing machine.

As another embodiment of the invention, when a wireless IC tag is installed in a packaging object, fluctuations in printing quality can be reduced and printed matters with stable quality can be obtained constantly, in the plate-making and printing methods employing an aggregate of lithographic printing plate materials.

An aggregate of lithographic printing plate materials relating to the invention is one of lithographic printing plate materials having, on its support, an image forming layer which can make a printing plate by digital devices such as a laser, a thermal head and an ink-jet head, and the invention can be applied preferably to an aggregate of lithographic printing plate materials which have the same manufacturing conditions, preservation conditions after manufacturing and plate-making conditions.

A packaging object for an aggregate of lithographic printing plate materials of the invention is one that can hold a large number of lithographic printing plate materials as an aggregate, and in particular, a medium capable of holding in a movable manner as an aggregate is preferable.

As a medium capable of holding in a movable manner, there are given, for example, packing paper having functions of light shielding and moisture proofing, a cassette-shaped casing having a function of light shielding and palettes for vertical stacking and horizontal stacking.

As a method of installing a wireless IC tag in a packaging object, it is possible to fix by a method to paste by using adhesive agents, but, it is preferable to fix through an insulating object when a packaging object is made of metal.

As a configuration to fix a wireless IC tag on a packaging object, there are given a configuration wherein a recessed portion is provided on a part of the packaging object, and a wireless IC tag is embedded in the recessed portion, and a configuration wherein a wireless IC tag is pasted on the packaging object so that a convex portion may be formed.

Figure 8:
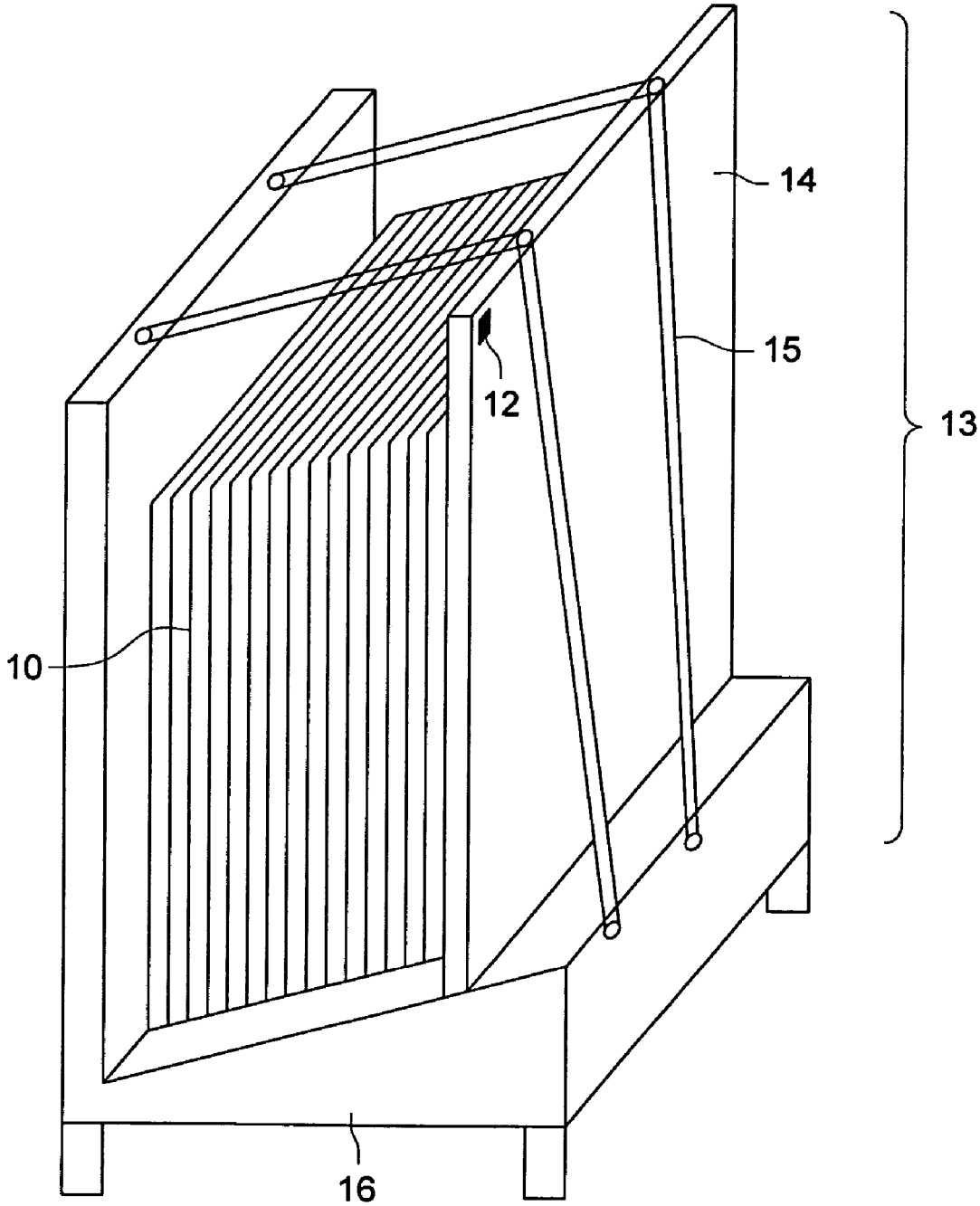
FIG. 8 is a schematic diagram showing an embodiment of a packaging object for lithographic printing plate materials and an aggregate of lithographic printing plate materials of the invention.
Figure 9:
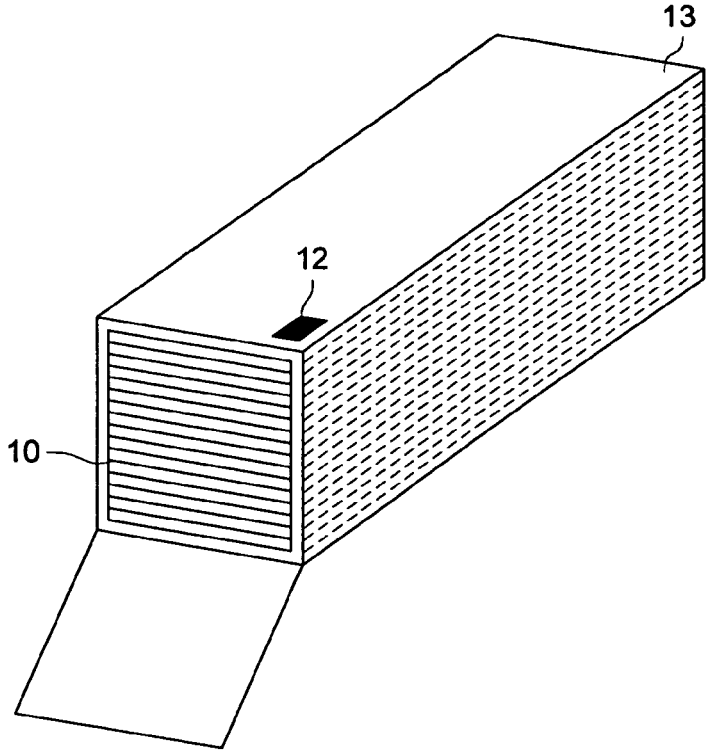
FIG. 9 is a schematic diagram showing another embodiment of a packaging object for lithographic printing plate materials and an aggregate of lithographic printing plate materials of the invention.
Figure 10:
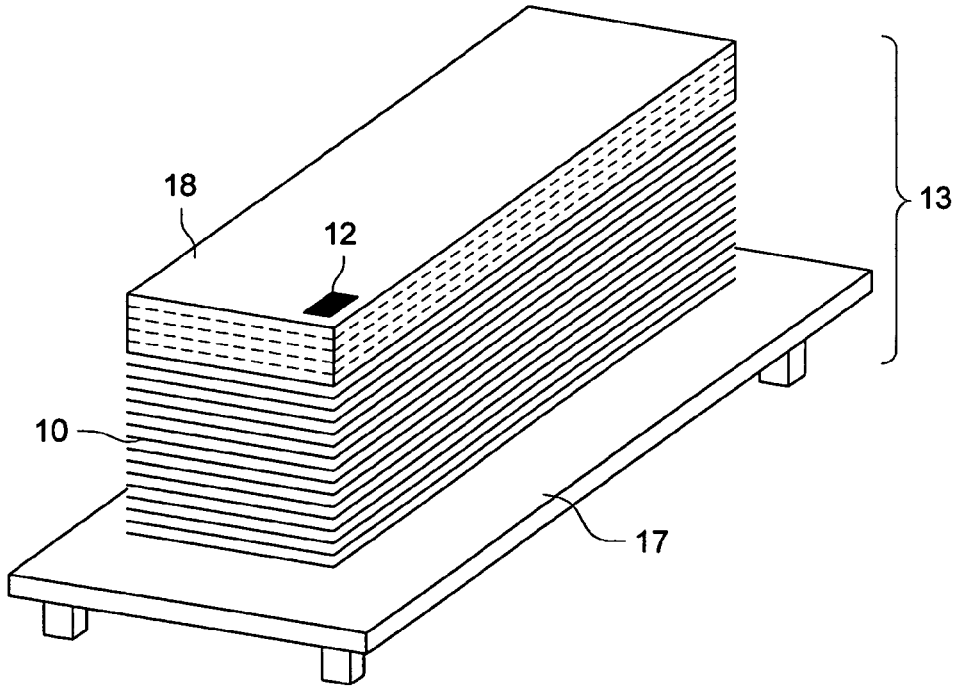
FIG. 10 is a schematic diagram showing still another embodiment of a packaging object for lithographic printing plate materials and an aggregate of lithographic printing plate materials of the invention.

Each of FIGS. 8, 9 and 10 shows an example of the packaging object of the invention on which a wireless IC tag is installed.

In FIG. 8, aggregate of lithographic printing plate materials 10 are held on vertical stacking palette 15 that is made of steel, holding wooden plate 14, and wireless IC tag 12 is fixed on the upper portion of the wooden plate 14 through unillustrated insulating object and adhesive agents.

In FIG. 9, aggregate 1 of lithographic printing plate materials is loaded in packaging object 13 representing a box-shaped cassette made of plastic, and wireless IC tag 12 is fixed on the upper portion of the packaging object 13 through unillustrated adhesive agents.

In FIG. 10, aggregate 10 of lithographic printing plate materials is held on stand 17, an upper portion of lithographic printing plate materials 10 is covered by cover 18 that is made of corrugated cardboard, and wireless IC tag 12 is fixed on the cover 18 through unillustrated adhesive agents, in packaging object 13.

In any case of the foregoing, the aggregate 10 of lithographic printing plate materials may also be covered by a moisture-proof sheet.

The wireless IC tag relating to the invention holds data of information concerning printing plate materials.

As information of data held by the wireless IC tag, there are given pieces of information about printing including 1) a type of a printing plate, 2) a product lot, 3) printing plate sizes (width, length and thickness), 4) date of manufacturing (expiration date), 5) manufacturing information such as information of troubles in manufacturing (positions and types), 6) performance information such as sensitivity information of a printing plate material, 7) exposure conditions (light source output, revolutions per minute of a photosensitive drum), 8) plate-making apparatus information such as development time and development temperature and 9) printing conditions (pre-dampening conditions, printing pressure, water-ink balance).

Though the aforesaid pieces of information can be inputted in any manner optionally, it is also possible to write in with a reader/writer after manufacturing, after imagewise exposure or after development.

By holding these pieces of information in the wireless IC tag and by utilizing them, it is possible to control a plate-making process (exposure process and development process) and a printing process efficiently, so that fluctuations in quality of printed matters may be reduced.

In particular, if exposure conditions are held in the wireless IC tag not only as a single condition for a production lot or for a type of printing plate material but also as a function with plate-making apparatus conditions such as ambient temperature and humidity and exposure output during the exposure, it is possible to determine plate-making conditions by comparing and calculating data of peculiar information of printing plate materials and data of plate-making apparatus conditions, and thereby to reduce fluctuations in quality of printed matters through the control at higher accuracy.

In the case of printing plate materials which vary in terms of performance on an aging basis after manufacturing, if the relationship between elapsed time after manufacturing and optimum plate-making conditions is held as data of peculiar information for plate-making, it is possible to correct substantial fluctuations of performance, and thereby to make appropriate performance to be exhibited.

In the plate-making method of the invention, imagewise exposure is carried out by controlling imagewise exposure conditions based on data held in the wireless IC tag for printing plate materials and packaging objects.

Further, in the plate-making method of the invention, photographic processing is carried out by controlling development conditions based on data held in the wireless IC tag for printing plate materials and packaging objects.

Namely, in the plate-making method of the invention, data held in the wireless IC tag for printing plate materials and packaging objects, plate-making apparatus information and data of the plate-making apparatus information are compared and calculated, and imagewise exposure conditions and photographic processing conditions are controlled based on the results of the calculation.

The plate-making apparatus information includes output information of a light source for exposure, ambient information for exposure, information of developer solutions, development time and information of development temperature.

The data held in the wireless IC tag for printing plate materials and packaging objects are data of sensitivity information of printing plate materials, and data of plate-making apparatus information are data of output conditions for the light source for exposure and of exposure ambient conditions, and great effects are exhibited when these data are compared and calculated to control imagewise exposure conditions based on the results of the calculation.

The data held in the wireless IC tag for printing plate materials and packaging objects are data of aging information after manufacturing for printing plate materials and/or exposure conditions, and data of plate-making apparatus information are data of development temperature and development time for photographing processing, and great effects are exhibited when these data are compared and calculated to control conditions for photographic processing based on the results of the calculation.

It is possible to add additional information on the wireless IC tag in the course of using printing plate materials in the plate-making apparatus, and information to be added includes 1) remaining length of materials and 2) plate-making history (the date and time, exposure conditions, output image data ID, development conditions and printing conditions).

In the printing method of the invention, printing is carried out by using a printing plate that is made by conducting imagewise exposure and photographic processing for the printing plate material having thereon a wireless IC tag on which data of information about printing plate material are held, and printing conditions are controlled for performing printing based on data of information concerning printing plate material held on the wireless IC tag.

Namely, in the printing method of the invention, data held in the wireless IC tag during the period up to the plate-making process are read by a reading means attached on a printing machine from the wireless IC tag, and those data and data of printing machine information for the printing machine are compared and calculated, thus, printing conditions are controlled based on the results of the calculation for performing printing.

Though printing machine information includes pre-dampening conditions, printing pressure conditions, an amount of supply for wetting water and information about printing paper, it is possible to control higher accurate printing conditions, by using data obtained by comparing and calculating the aforesaid information and another information that varies for each printing plate such as printing colors and image areas.

(Aluminum Support)

An aluminum support according to this invention is an aluminum plate material which can hold an image forming layer.

As an aluminum support according to this invention, pure aluminum or aluminum alloys can be utilized.

As aluminum alloys, various types can be utilized and, for example, utilized are alloys of metal, such as silica, copper, manganese, magnesium, chromium, zinc, lead, bismuth, nickel, titanium, sodium and iron, with aluminum.

An aluminum support is provided with a hydrophilic surface on the side having an image forming layer, and the hydrophilic surface has been preferably roughened.

An aluminum support is preferably subjected to a degrease treatment to eliminate rolling oil on the aluminum surface prior to a surface roughening treatment. As a degrease treatment, employed are such as a degrease treatment using a solvent such as trichlene and thinner, and an emulsion degrease treatment using an emulsion of such as kecirone and triethanol amine. Further, in a degrease treatment, an alkaline aqueous solution of such as sodium hydroxide, potassium hydroxide, sodium carbonate and sodium phosphate can be utilized. In the case of utilizing an alkali aqueous solution for a degrease treatment, dirt and oxidized film, which cannot be eliminated only by the above-described degrease treatment, can be also eliminated.

In the case of an alkaline aqueous solution having been utilized for a degrease treatment, the aluminum support is preferably subjected to a neutralizing treatment by being immersed in acid such as phosphoric acid, nitric acid, hydrochloric acid, sulfuric acid and chromic acid; or mixed acid thereof. When electrolytic surface roughening is performed after a neutralizing treatment, acid utilized in a neutralizing treatment specifically preferably coincides with acid used in electrolytic surface roughening.

Roughening of a support is performed by an electrolytic roughening treatment according to a commonly known method, however, a roughening treatment, in which an appropriate treating degree of chemical roughening or mechanical roughening is combined as a preliminary treatment, may be performed.

For a chemical roughening treatment, an alkaline aqueous solution of such as sodium hydroxide, potassium hydroxide, sodium carbonate and sodium phosphate is utilized similar to a degreasing treatment.

It is preferable to provide a neutralizing treatment after the chemical roughening treatment by immersing the support in acid such as phosphoric acid, nitric acid, hydrochloric acid and chromic acid or mixed acid thereof. In the case of an electrolytic surface roughening being performed after a neutralizing treatment, acid utilized for neutralization preferably coincides with acid used in electrolytic surface roughening.

A mechanical roughening treatment method is not specifically limited, however, preferable are blush grinding and horning grinding.

A substrate which has been mechanically surface roughened is preferably immersed in an aqueous solution of acid or alkali to etch the surface, in order to eliminate such as an abrasive and aluminum dust encroached on the substrate surface, or to control the pit shape. Acid includes such as sulfuric acid, persulfuric acid, hydrofluoric acid, phosphoric acid, nitric acid and hydrochloric acid, and base includes such as sodium hydroxide, potassium hydroxide, sodium carbonate and sodium phosphate. Among them, an aqueous solution of alkali is preferably utilized.

By utilizing an abrasive having a particle size of not more than #400 in mechanical roughening and performing an etching treatment by an alkali solution after the mechanical roughening treatment, a complicated roughened structure by a mechanical roughening treatment can be changed into the surface having smooth roughness.

In the case that the above support has been immersing treated with an alkaline aqueous solution, it is preferable to be subjected to a neutralization treatment by being immersed in acid such as phosphoric acid, nitric acid, sulfuric acid and chromic acid or mixed acid thereof.

When an electrolytic roughening treatment is performed after a neutralizing treatment, acid utilized in a neutralizing treatment specifically preferably coincides with acid used in an electrolytic roughening treatment.

In an electrolytic roughening treatment, roughening is generally performed by utilizing alternating current in an acid electrolytic solution. As an acid electrolytic solution, those utilized in an ordinary electrolytic roughening treatment can be employed, however, a hydrochloric acid type or nitric acid type electrolytic solution is preferably utilized and a hydrochloric acid type electrolytic solution is specifically preferably utilized in this invention.

As an electric source wave form utilized in electrolysis, various wave forms such as a rectangular wave, a trapezoid wave and a serrate wave can be utilized, however, preferable is a sine wave.

Further, a divisional electrolytic roughening treatment such as disclosed in JP-A No. 10-869 (JP-A refers to Japanese Patent Publication Open to Public Inspection) is also preferably utilized.

A voltage applied in an electrolytic roughening utilizing a nitric acid type electrolytic solution is preferably 1-50 V and more preferably 5-30 V. A current density (a peak value) is preferably 10-200 A/dm$^2$ and more preferably 20-150 A/dm$^2$.

A quantity of electricity is 100-2000 C/dm$^2$, preferably 200-1500 C/dm$^2$ and more preferably 200-1000 C/dm$^2$, as a total of the whole treatment process.

The temperature is preferably 10-50° C. and more preferably 15-45° C. A concentration of nitric acid is preferably 0.1-5 weight %.

Into an electrolytic solution, such as nitrate, chloride, amines, aldehydes, phosphoric acid, chromic acid, boric acid, acetic acid and oxalic acid can be added.

The substrate having been subjected to an electrolytic roughening treatment is preferably immersed in an alkaline solution to perform etching of the surface for the purpose of such as eliminating smuts from the surface and to control the pit shape.

An alkaline aqueous solution includes an aqueous solution of such as sodium hydroxide, potassium hydroxide, sodium carbonate and sodium phosphate.

By performing an etching treatment with an alkaline aqueous solution, initial printability and prevention of scumming are improved when an image forming layer is provided.

In the case that the above support has been immersing treated with an alkaline aqueous solution, it is preferable to be subjected to a neutralization treatment by being immersed in acid such as phosphoric acid, nitric acid, sulfuric acid and chromic acid or mixed acid thereof. When an anodic oxidation treatment is performed after a neutralizing treatment, acid utilized in a neutralizing treatment specifically preferably coincides with acid used in an anodic oxidation treatment.

An anodic oxidation treatment is performed after roughening treatment.

A method of anodic oxidation treatment is not specifically limited and commonly known method can be utilized. Oxidation film is formed on a substrate by an anodic oxidation treatment. In this invention, for an anodic oxidation treatment, preferably utilized is a method in which an aqueous solution containing 10-50 weight % of such as sulfuric acid and/or phosphoric acid is employed as an electrolytic solution and electrolysis is performed at a current density of 1-10 A/dm$^2$, however, also utilized can be a method in which electrolysis is performed at a high current density in sulfuric acid as described in U.S. Pat. No. 1,412,768, and a method in which electrolysis is performed by use of phosphoric acid as described in U.S. Pat. No. 3,511,661.

A support having been anodic oxidation treated may be appropriately subjected to a sealing treatment. The sealing treatment can be performed by a commonly known method such as a hot water treatment, a boiling water treatment, a vapor treatment, a dichromate aqueous solution treatment, a nitrite treatment and an ammonium acetate treatment.

Further, a support having been anodic oxidation treated is also appropriately subjected to a surface treatment other than the above-described sealing treatment. The surface treatment includes commonly known treatments such as a silicate treatment, a phosphate treatment, various organic solvent treatments, a PVPA treatment and boehmite treatment. Further, a treatment by an aqueous solution containing hydrogencarbonate as described in JP-A No. 8-314157, and an organic acid treatment by such as citric acid may be performed in succession to a treatment by an aqueous solution containing hydrogencarbonate.

(Image Formation Layer)

The image formation layer in the invention is a layer capable of forming an image by imagewise exposure. As the image formation layer, a positive or negative working image formation layer used in a conventional light sensitive planographic printing plate material can be used.

As the image formation layer in the invention, a thermosensitive image formation layer or polymerizable image formation layer is preferably used.

As the thermosensitive image formation layer, a layer capable of forming an image employing heat generated due to laser exposure is preferred.

As the layer capable of forming an image employing heat generated due to laser exposure, a positive working thermosensitive image formation layer containing a compound capable of being decomposed by an acid or a negative working image formation layer such as a thermosensitive image formation layer containing a polymerizable composition or a thermosensitive image formation layer containing thermoplastic particles are preferably used.

As the positive working image formation layer containing a compound capable of being decomposed by an acid, there is, for example, an image formation layer comprising a photolytically acid generating compound capable of generating an acid on laser exposure, an acid decomposable compound, which is capable of being decomposed by an acid to increase solubility to a developer, and an infrared absorber, as disclosed in Japanese Patent O.P.I. Publication Nos. 9-171254.

As the photolytically acid generating compound there are various conventional compounds and mixtures. For example, a salt of diazonium, phosphonium, sulfonium or iodonium ion with $BF_4^-$, $PF_6^-$, $SbF_6^-SiF_6^{2-}$ or $ClO_4^-$, an organic halogen containing compound, o-quinonediazide sulfonylchloride or a mixture of an organic metal and an organic halogen-containing compound is a compound capable of generating or releasing an acid on irradiation of an active light, and can be used as the photolytically acid generating compound in the invention. The organic halogen-containing compound known as an photoinitiator capable of forming a free radical is a compound capable of generating a hydrogen halide and can be used as the photolytically acid generating compound. The examples of the organic halogen containing compound capable of forming a hydrogen halide include those disclosed in U.S. Pat. Nos. 3,515,552, 3,536,489 and 3,779,778 and West German Patent No. 2,243,621, and compounds generating an acid by photodegradation disclosed in West German Patent No. 2,610,842. As the photolytically acid generating compound, o-naphthoquinone diazide-4-sulfonylhalogenides disclosed in Japanese Patent O.P.I. Publication No. 50-30209 can be also used.

As the photolytically acid generating compound, an organic halogen-containing compound is preferred in view of sensitivity to infrared rays and storage stability. The organic halogen-containing compound is preferably a halogenated alkyl-containing triazines or a halogenated alkyl-containing oxadiazoles, and especially preferably a halogenated alkyl-containing s-triazines.

The content of the photolytically acid generating compound in the image formation layer is preferably 0.1 to 20% by weight, and more preferably 0.2 to 10% by weight based on the total weight of the solid components of the image formation layer, although the content broadly varies depending on its chemical properties, or kinds or physical properties of image formation layer used.

As the acid decomposable compound, there are a compound having a C—O—C bond disclosed in Japanese Patent O.P.I. Publication Nos. 48-89003, 51-120714, 53-133429, 55-12995, 55-126236 and 56-17345, a compound having an Si—O—C bond disclosed in Japanese Patent O.P.I. Publication Nos. 60-37549 and 60-121446, another acid decomposable compound disclosed in Japanese Patent O.P.I. Publication Nos. 60-3625 and 60-10247, a compound having an Si—N bond disclosed in Japanese Patent O.P.I. Publication No. 62-222246, a carbonic acid ester disclosed in Japanese Patent O.P.I. Publication No. 62-251743, an orthocarbonic acid ester disclosed in Japanese Patent O.P.I. Publication No. 62-209451, an orthotitanic acid ester disclosed in Japanese Patent O.P.I. Publication No. 62-280841, an orthosilicic acid ester disclosed in Japanese Patent O.P.I. Publication No. 62-280842, an acetal or ketal disclosed in Japanese Patent O.P.I. Publication No. 63-10153 and a compound having a C—S bond disclosed in Japanese Patent O.P.I. Publication No. 62-244038. Of these compounds, the compound having a C—O—C bond, the compound having an Si—O—C bond, the orthocarbonic acid ester, the acetal or ketal or the silylether disclosed in Japanese Patent O.P.I. Publication Nos. 53-133429, 56-17345, 60-121446, 60-37549, 62-209451 and 63-10153 are preferable.

The content of the acid decomposable compound in the image formation layer is preferably 5 to 70% by weight, and more preferably 10 to 50% by weight based on the total weight of the solid components of the image formation layer. The acid decomposable compounds may be used alone or as an admixture of two or more kinds thereof.

The image formation layer in the invention preferably contains a light-to-heat conversion material which is capable of changing exposure light to heat. Examples of the light-to-heat conversion material include the following light-to-heat conversion dye or light-to-heat conversion material substances.

(0124) [Light-to-heat Conversion Dye]

Examples of the light-to-heat conversion dye include a general infrared absorbing dye such as a cyanine dye, a chloconium dye, a polymethine dye, an azulenium dye, a squalenium dye, a thiopyrylium dye, a naphthoquinone dye or an anthraquinone dye, and an organometallic complex such as a phthalocyanine compound, a naphthalocyanine compound, an azo compound, a thioamide compound, a dithiol compound or an indoaniline compound. Exemplarily, the light-to-heat conversion materials include those disclosed in Japanese Patent O.P.I. Publication Nos. 63-139191, 64-33547, 1-160683, 1-280750, 1-293342, 2-2074, 3-26593, 3-30991, 3-34891, 3-36093, 3-36094, 3-36095, 3-42281, 3-97589 and 3-103476. These compounds may be used singly or in combination.

Those described in Japanese Patent O.P.I. Publication Nos. 11-240270, 11-265062, 2000-309174, 2002-49147, 2001-162965, 2002-144750, and 2001-219667 can be preferably used.

[Other Light-to-heat Conversion Materials]

In addition to the above light-to-heat conversion dye, other light-to-heat conversion materials may be used.

Examples of the light-to-heat conversion material include carbon, graphite, a metal and a metal oxide.

Furnace black and acetylene black is preferably used as the carbon. The graininess ($d_{50}$) thereof is preferably not more than 100 nm, and more preferably not more than 50 nm.

The graphite is one having a particle size of preferably not more than 0.5 μm, more preferably not more than 100 nm, and most preferably not more than 50 nm.

As the metal, any metal can be used as long as the metal is in a form of fine particles having preferably a particle size of not more than 0.5 μm, more preferably not more than 100 nm, and most preferably not more than 50 nm. The metal may have any shape such as spherical, flaky and needle-like. Colloidal metal particles such as those of silver or gold are particularly preferred.

As the metal oxide, materials having black color in the visible regions or materials which are electro-conductive or semi-conductive can be used.

Examples of the former include black iron oxide and black complex metal oxides containing at least two metals.

Examples of the latter include Sb-doped $SnO_2$ (ATO), Sn-added $In_2O_3$ (ITO), $TiO_2$, TiO prepared by reducing $TiO_2$ (titanium oxide nitride, generally titanium black).

Particles prepared by covering a core material such as $BaSO_4$, $TiO_2$, $9Al_2O_3.2B_2O$ and $K_2O.nTiO_2$ with these metal oxides is usable.

These oxides are particles having a particle size of not more than 0.5 μm, preferably not more than 100 nm, and more preferably not more than 50 nm.

As these light-to-heat conversion materials, black iron oxide or black complex metal oxides containing at least two metals are more preferred.

Examples of the black complex metal oxides include complex metal oxides comprising at least two selected from Al, Ti, Cr, Mn, Fe, Co, Ni, Cu, Zn, Sb, and Ba. These can be prepared according to the methods disclosed in Japanese Patent O.P.I. Publication Nos. 9-27393, 9-25126, 9-237570, 9-241529 and 10-231441.

The complex metal oxide used in the invention is preferably a complex Cu—Cr—Mn type metal oxide or a Cu—Fe—Mn type metal oxide. The Cu—Cr—Mn type metal oxides are preferably subjected to the treatment disclosed in Japanese Patent O.P.I. Publication Nos. 8-27393 in order to reduce isolation of a 6-valent chromium ion. These complex metal oxides have a high color density and a high light heat conversion efficiency as compared with another metal oxide.

The primary average particle size of these complex metal oxides is preferably from 0.001 to 1.0 μm, and more preferably from 0.01 to 0.5 μm. The primary average particle size of from 0.001 to 1.0 μm improves a light heat conversion efficiency relative to the addition amount of the particles, and the primary average particle size of from 0.05 to 0.5 μm further improves a light heat conversion efficiency relative to the addition amount of the particles. The light heat conversion efficiency relative to the addition amount of the particles depends on a dispersity of the particles, and the well-dispersed particles have a high light heat conversion efficiency.

Accordingly, these complex metal oxide particles are preferably dispersed according to a known dispersing method, separately to a dispersion liquid (paste), before being added to a coating liquid for the particle containing layer. The metal oxides having a primary average particle size of less than 0.001 are not preferred since they are difficult to disperse. A dispersant is optionally used for dispersion. The addition amount of the dispersant is preferably from 0.01 to 5% by weight, and more preferably from 0.1 to 2% by weight, based on the weight of the complex metal oxide particles.

The image formation layer optionally contains a binder.

The light-to-heat conversion dye or light-to-heat conversion material described above may be contained in the image formation layer or in a layer adjacent thereto.

[Light-sensitive Image Formation Layer Containing a Polymerizable Component]

As an image formation layer containing a polymerizable component, there is an image formation layer containing a light-to-heat conversion material (a) having an absorption band in a wavelength region of from 700 to 1300 nm, a polymerization initiator (b) and a polymerizable ethylenically unsaturated monomer (c).

(Light-to-heat Conversion Material (a) Having an Absorption Band in a Wavelength Region of from 700 to 1300 nm)

As the light-to-heat conversion material (a) having an absorption band in a wavelength region of from 700 to 1300 nm, There are the infrared absorbing dyes described above. Preferred are dyes such as cyanine dyes, squalirium dyes, oxonol dyes, pyrylium dyes, thiopyrylium dyes, polymethine dyes, oil soluble phthalocyanine dyes, triarylamine dyes, thiazolium dyes, oxazolium dyes, polyaniline dyes, polypyrrole dyes and polythiophene dyes.

Besides the above, pigments such as carbon black, titanium black, iron oxide powder, and colloidal silver can be preferably used. Cyanine dyes as dyes, and carbon black as pigments are especially preferred, in view of extinction coefficient, light-to-heat conversion efficiency and cost.

The content of the light-to-heat conversion material having an absorption band in a wavelength region of from 700 to 1300 nm in the image formation layer is preferably from 0.5 to 15% by weight and more preferably from 1 to 5% by weight. Further, the content of the colorant in the image formation layer is different due to extinction coefficient of the colorant, but is preferably an amount giving a reflection density of from 0.3 to 3.0, and preferably from 0.5 to 2.0. For example, in order to obtain the above reflection density, the content of the cyanine dye in the image formation layer is 10 to 100 $mg/m^2$.

This light-to-heat conversion material also may be contained in the image formation layer or in a layer adjacent thereto.

((b) Polymerization Initiator)

The photopolymerization initiator is a compound capable of initiating polymerization of an unsaturated monomer by laser. Examples thereof include carbonyl compounds, organic sulfur compounds, peroxides, redox compounds, azo or diazo compounds, halides and photo-reducing dyes disclosed in J. Kosar, "Light Sensitive Systems", Paragraph 5, and those disclosed in British Patent No. 1,459,563.

The content of the polymerization initiator in the image formation layer is not specifically limited, but is preferably from 0.1 to 20% by weight, and more preferably from 0.8 to 15% by weight.

((c) Polymerizable Ethylenically Unsaturated Monomer)

The polymerizable ethylenically unsaturated monomer is a compound having a polymerizable unsaturated group. Examples thereof include conventional radical polymerizable monomers, and polyfunctional monomers having plural ethylenically unsaturated bond and polyfunctional oligomers used in UV-curable resins.

A prepolymer can be used as described above, and the prepolymer can be used singly, as an admixture of the above described monomers and/or oligomers.

(Polymer Binder)

The image formation layer in the invention can contain a polymer binder.

Examples of the polymer binder include a polyacrylate resin, a polyvinylbutyral resin, a polyurethane resin, a polyamide resin, a polyester resin, an epoxy resin, a phenol resin, a polycarbonate resin, a polyvinyl butyral resin, a polyvinyl formal resin, a shellac resin, or another natural resin. These polymer binder can be used as an admixture of two or more thereof.

(Polymerization Inhibitor)

The image formation layer in the invention can optionally a polymerization inhibitor.

As the polymerization inhibitor, there is for example, a hindered amine with a pKb of from 7 to 14 having a piperidine skeleton.

The polymerization inhibitor content is preferably from 0.001 to 10% by weight, more preferably from 0.01 to 10% by weight, and still more preferably from 0.1 to 5% by weight based on the total solid content of polymerizable unsaturated group-containing compound in the image formation layer.

The image formation layer can contain a colorant. As the colorant can be used known materials including commercially available materials. Examples of the colorant include those described in revised edition "Ganryo Binran", edited by Nippon Ganryo Gijutu Kyoukai (publishe by Seibunndou Sinkosha), or "Color Index Binran". Pigment is preferred.

Kinds of the pigment include black pigment, yellow pigment, red pigment, brown pigment, violet pigment, blue pigment, green pigment, fluorescent pigment, and metal powder pigment. Examples of the pigment include inorganic pigment (such as titanium dioxide, carbon black, graphite, zinc oxide, Prussian blue, cadmium sulfide, iron oxide, or chromate of lead, zinc, barium or calcium); and organic pigment (such as azo pigment, thioindigo pigment, anthraquinone pigment, anthanthrone pigment, triphenedioxazine pigment, vat dye pigment, phthalocyanine pigment or its derivative, or quinacridone pigment).

Among these pigment, pigment is preferably used which does not substantially have absorption in the absorption wavelength regions of a spectral sensitizing dye used according to a laser for exposure. The absorption of the pigment used is not more than 0.05, obtained from the reflection spectrum of the pigment measured employing an integrating sphere and employing light with the wavelength of the laser used. The pigment content is preferably 0.1 to 10% by weight, and more preferably 0.2 to 5% by weight, based on the total solid content of image formation layer.

[Light-sensitive Image Formation Layer Containing a Thermoplastic Material]

As a light-sensitive image formation layer containing a thermoplastic material, an image formation layer containing heat melting particles or heat fusing particles may be preferable, in particular, an image formation layer usable in a so-called process-less CTP.

(Heat-melting Particles)

The heat-melting particles used in the invention are particularly particles having a low melt viscosity, or particles formed from materials generally classified into wax.

The materials preferably have a softening point of from 40° C. to 120° C. and a melting point of from 60° C. to 150° C., and more preferably a softening point of from 40° C. to 100° C. and a melting point of from 60° C. to 120° C.

Materials usable include paraffin, polyolefin, polyethylene wax, microcrystalline wax, and fatty acid wax.

The molecular weight thereof is approximately from 800 to 10,000. A polar group such as a hydroxyl group, an ester group, a carboxyl group, an aldehyde group and a peroxide group may be introduced into the wax by oxidation to increase the emulsification ability.

Moreover, stearoamide, linolenamide, laurylamide, myristylamide, hardened cattle fatty acid amide, parmitylamide, oleylamide, rice bran oil fatty acid amide, palm oil fatty acid amide, a methylol compound of the above-mentioned amide compounds, methylenebissteastearoamide and ethylenebissteastearoamide may be added to the wax to lower the softening point or to raise the working efficiency. A cumarone-indene resin, a rosin-modified phenol resin, a terpene-modified phenol resin, a xylene resin, a ketone resin, an acryl resin, an ionomer and a copolymer of these resins may also be usable.

Among them, polyethylene, microcrystalline wax, fatty acid ester and fatty acid are preferably contained. A high sensitive image formation can be performed since these materials each have a relative low melting point and a low melt viscosity. These materials each have a lubrication ability. Accordingly, even when a shearing force is applied to the surface layer of the printing plate precursor, the layer damage is minimized, and resistance to contaminations which may be caused by scratch is further enhanced.

The heat-melting particles are preferably dispersible in water. The average particle size thereof is preferably from 0.01 to 10 μm, and more preferably from 0.05 to 3 μm.

When the average particle size is larger than 10 μm, an image resolution will be lowered.

When two or more kinds of the particles are used, the average particle size difference between the different particles is preferably not less than 0.1 μm.

A nonionic surfactant, an anionic surfactant, a cationic surfactant, or a polymeric surfactant is preferably employed to disperse these heat-melting particles in water. A heat-melting particle aqueous dispersion, containing these surfactants, can be stabilized, providing a uniform coat with no deficiencies.

Preferred examples of the nonionic surfactant include polyoxyethylene adducts such as alkyl polyoxyethylene ether, alkyl polyoxyethylene, polyoxypropylene ether, fatty acid polyoxyethylene ester, fatty acid polyoxyethylene sorbitan ester, fatty acid polyoxyethylene sorbitol ester, polyoxyethylene castor oil, polyoxyethylene adduct of acetylene glycol, and alkyl polyoxyethylene amine or amide; polyols such as fatty acid sorbitan ester, fatty acid polyglycerin ester and fatty acid sucrose ester or alkylolamide; silicon atom-containing surfactants, which are polyether modified, alkyl aralkyl polyether modified, epoxy polyether modified, alcohol modified, fluorine modified, amino modified, mercapto modified, epoxy modified, or allyl modified; fluorine atom-containing surfactants of perfluoroalkyl ethyleneoxide adduct; and others such as lipid-containing material, biosurfactant, or oligo soap. At least one kind of these can be used.

Preferred examples of the cationic surfactant include alkylamine salts or acylamine salts such as primary amine salts, acylaminoethylamine salts, N-alkylpolyalkylene polyamine salts, fatty acid polyethylene polyamide, amides or their salts, or amine salts; quaternary ammonium salts or ammonium salts having an amide bond such as alkyltrimethylammonium salt, dialkyldimethylammonium salt, alkyldimethylbenzyl ammonium salt, alkylpridium salt, acylaminoethylmethyldiethyl ammonium salt, acylaminopropyldimethylbenzyl ammonium salt, acylaminopropyl-diethylhydroxyethyl ammonium salt, acylaminoethyl pyridinium salt, or diacylaminoethyl ammonium salt; ammonium salts having an ester bond or an ether bond such as diacyloxyethylmethylhydroxyethyl ammonium salt or alkyloxymethyl pyridinium salt; imidazolines or imidazolium salts such as alkyl imidazoline, 1-hydroxyethyl-2-alkyl imidazoline, or 1-acylaminoethyl-2-alkylimidazolium salt; amine derivatives such as alkylpolyoxyethylene amine, N-alkylaminopropyl amine, N-acylpolyethylene polyamine, acylpolyethylene polyamine, or fatty acid triethanolamine ester; and others such as lipid-containing material, biosurfactant or oligo soap. At least one kind of these can be used.

Preferred examples of the anionic surfactant include carboxylic acid salts such as fatty acid salt, rosin group, naphthene group, ether carboxylate, alkenyl succinate, N-acyl sarcosine salt, N-acyl glutamate, sulfuric acid primary alkyl salt, sulfuric acid secondary alkyl salt, sulfuric acid alkyl polyoxyethylene salt, sulfuric acid alkylphenyl polyoxyethylene salt, sulfuric acid mono-acyl glycerin salt, acyl amino sulfuric acid ester salt, sulfuric acid oil, or sulfation aliphatic acid alkyl ester; sulfonic acid such as α-olefin sulfonate, secondary alkane sulfonate, α-sulfo aliphatic acid, acyl isethionic acid salt, N-acyl-N-methyl taurine acid, dialkyl sulfo succinate, alkylbenzenesulfonate, alkylnaphthalenesulfonate, alkyl diphenyl ether disulfonate, petroleum sulfonate, or lignin sulfonate; phosphoric ester acid salt such as phosphoric acid alkyl salt or phosphoric acid alkyl polyoxyethylene salt; silicon atom-containing anionic surfactant such as sulfonic acid modified or carboxyl modified; fluorine atom-containing surfactant such as perfluoro alkyl carboxylic acid salt, perfluoro alkyl sulfonic acid salt, perfluoro alkyl phosphoric acid ester, or perfluoro alkyl trimethyl ammonium salt; and others such as lipid-containing material, biosurfactant, or oligo soap. At least one kind of these can be used.

Preferred examples of the polymeric surfactant include polymer or copolymer of poly alkyl (meth) acrylic acid such as poly (meth) acrylate, butyl (meth) acrylate acrylic acid copolymer, ethylene-acrylic acid copolymer, or ethylene-methacrylic acid copolymer; maleic acid copolymer such as vinyl acetate-maleic anhydride copolymer, styrene-maleic anhydride copolymer, α-olefin-maleic anhydride copolymer, or diisobutylene-maleic acid copolymer; fumaric acid copolymer such as methyl (meth) acrylate-fumaric acid copolymer or vinyl acetate-fumaric acid copolymer; aromatic sulfonic-acid formalin condensation product such as naphthalene sulfonic acid formalin condensation product, butyl naphthalene sulfonic acid formalin condensation product, or cresol sulfonic-acid formalin condensation product; poly alkyl pyridinium salt (including derivatives of the copolymer obtained via copolymerization with vinyl monomer copolymerized with vinylpyridine) such as poly N-methylvinyl pyridinium chloride, or so forth; polyacrylamide, polyvinyl pyrrolidone, poly acryloyl pyrrolidone, polyvinyl alcohol, polyethylene glycol; block polymer of polyoxyethylene and polyoxypropylene; cellulose derivative such as methylcellulose or carboxymethyl cellulose; and polysaccharide derivative such as poly oxyalkylene polysiloxane copolymer, gum arabic, or arabinogalactan. At least one kind of these can be used. As for the above polymeric surfactant examples, alkali salt such as sodium, potassium, or ammonium may be allowed to be used in place of a polymeric surfactant containing a carboxyl group or a sulfone group.

The composition of the heat-melting particles may be continuously varied from the interior to the surface of the particles. The particles may be covered with a different material. Known microcapsule production method or sol-gel method can be applied for covering the particles.

The heat-melting particle content of the layer is preferably 1 to 90% by weight, and more preferably 5 to 80% by weight based on the total layer weight.

(Heat-fusible Particles)

The heat-fusible particles in the invention include thermoplastic hydrophobic polymer particles. Although there is no specific limitation to the upper limit of the softening point of the thermoplastic hydrophobic polymer particles, the softening point is preferably lower than the decomposition temperature of the polymer particles. The weight average molecular weight (Mw) of the polymer is preferably within the range of from 10,000 to 1,000,000.

Examples of the polymer consistituting the polymer particles include a diene (co)polymer such as polypropylene, polybutadiene, polyisoprene or an ethylene-butadiene copolymer; a synthetic rubber such as a styrene-butadiene copolymer, a methyl methacrylate-butadiene copolymer or an acrylonitrile-butadiene copolymer; a (meth)acrylate (co) polymer or a (meth)acrylic acid (co)polymer such as polymethyl methacrylate, a methyl methacrylate-(2-ethylhexyl) acrylate copolymer, a methyl methacrylate-methacrylic acid copolymer, or a methyl acrylate-(N-methylolacrylamide); polyacrylonitrile; a vinyl ester (co)polymer such as a polyvinyl acetate, a vinyl acetate-vinyl propionate copolymer and a vinyl acetate-ethylene copolymer, or a vinyl acetate-2-hexylethyl acrylate copolymer; and polyvinyl chloride, polyvinylidene chloride, polystyrene and a copolymer thereof. Among them, the (meth)acrylate polymer, the (meth)acrylic acid (co)polymer, the vinyl ester (co)polymer, the polystyrene and the synthetic rubbers are preferably used.

The polymer particles may be prepared from a polymer synthesized by any known method such as an emulsion polymerization method, a suspension polymerization method, a solution polymerization method and a gas phase polymerization method. The particles of the polymer synthesized by the solution polymerization method or the gas phase polymerization method can be produced by a method in which an organic solution of the polymer is sprayed into an inactive gas and dried, and a method in which the polymer is dissolved in a water-immiscible solvent, then the resulting solution is dispersed in water or an aqueous medium and the solvent is removed by distillation.

In both of the methods, a surfactant such as sodium lauryl sulfate, sodium dodecylbenzenesulfate or polyethylene glycol, or a water-soluble resin such as poly(vinyl alcohol) may be optionally used as a dispersing agent or stabilizing agent.

The heat-fusible particles are preferably dispersible in water. The average particle size of the heat-fusible particles is preferably from 0.01 to 10 μm, and more preferably from 0.1 to 3 μm.

Further, the composition of the heat-fusible particles may be continuously varied from the interior to the surface of the particles. The particles may be covered with a different material. As a covering method, known methods such as a microcapsule method and a sol-gel method are usable.

The heat-fusible particle content of the layer is preferably from 1 to 90% by weight, and more preferably from 5 to 80% by weight based on the total weight of the layer.

(Water-soluble Binder)

Examples of the water-soluble binder used in the image formation layer include polysaccharides, polyethylene oxide, polypropylene oxide, polyvinyl alcohol, polyethylene glycol (PEG), polyvinyl ether, latex of a conjugate diene polymer such as styrene-butadiene copolymer or methyl methacrylate-butadiene copolymer, acryl polymer latexes, vinyl polymer latexes, polyacrylamide, polyacrylic acid or its salt, and polyvinyl pyrrolidone. Of these, polyacrylic acid or its salt or polysaccharides are preferred, which do not lower printability.

In the invention, it is preferred that a coating solution for the image formation layer contain lower alcohols such as methanol, ethanol, isopropanol and butanol, in order to improve coating quality.

The image formation layer can contain light-to-heat conversion materials described later.

The dry coating amount of the image formation layer is preferably from 0.1 to 1.5 g/m$^2$, and more preferably from 0.15 to 1.0 g/m$^2$.

[Light-sensitive Image Formation Layer Containing a Thermoplastic Material]

As a light-sensitive image formation layer containing a thermoplastic material, an image formation layer containing particles capable of thermally bridging may be used. Among them, in particular, an image formation layer usable in a so-called process-less CTP. For example, a light-sensitive image formation layer containing a blocked isocyanate compound may be listed.

[Blocked Isocyanate Compound]

The blocked isocyanate compound is a compound obtained by addition reaction of an isocyanate compound with a blocking agent described below.

The blocked isocyanate compound used in the image formation layer is preferably in the form of aqueous dispersion of a compound described below. Coating of the aqueous dispersion provides good on press developability.

(Isocyanate Compound)

Examples of the isocyanate compound include an aromatic polyisocyanate such as diphenylmethane diisocyanate (MDI), tolylene diisocyanate (TDI), polyphenylpolymethylene polyisocyanate (crude MDI), or naphthalene diisocyanate (NDI); an aliphatic polyisocyanate such as 1,6-hexamethylene diisocyanate (HDI), or lysine diisocyanate (LDI); an alicyclic polyisocyanate such as isophorone diisocyanate (IPDI), dicyclohexylmethane diisocyanate (hydrogenation MDI), or cyclohexylene diisocyanate; an aromatic aliphatic Polyisocyanate such as xylylene diisocyanate (XDI), or tetramethylxylene diisocyanate (TMXDI); and their modified compounds such as those having a burette group, an isocyanurate group, a carbodiimide group, or an oxazolidine group); and a urethane polymer having an isocyanate group in the molecular end, which is comprised of an active hydrogen-containing compound with a molecular weight of from 50 to 5,000 and the polyisocyanate described above.

The polyisocyanates described in Japanese Patent O.P.I. Publication No. 10-72520 are preferably used.

Among those polyisocyanates, tolylene diisocyanate is especially preferred in view of high reactivity.

(Blocking Material)

Examples of the blocking material include an alcohol type blocking material such as methanol, or ethanol; a phenol type blocking material such as phenol or cresol; an oxime type blocking material such as formaldoxime, acetaldoxime, methyl ethyl ketoxime, methyl isobutyl ketoxime, cyclohexanone oxime, acetoxime, diacetyl monoxime, or benzophenone oxime; an acid amide type blocking material such as acetanilide, ϵ-caprolactam, or γ-butyrolactam; an active methylene containing blocking material such as dimethyl malonate or methyl acetoacetate; a mercaptan type blocking material such as butyl mercaptan; an imide type blocking material such as succinic imide or maleic imide; an imidazole type blocking material such as imidazole or 2-methylimidazole; a urea type blocking material such as urea or thiourea; an amine type blocking material such as diphenylamine or aniline; and an imine type blocking material such as ethylene imine or polyethylene imine. Among these, the oxime type blocking material is preferred.

It is preferred that the content of the blocking material is such an amount that the amount of the active hydrogen of the blocking material is from 1.0 to 1.1 equivalent of the isocyanate group of the isocyanate compound. It is preferred that when an active hydrogen-containing additive such as a polyol described later is used in combination, the content of the blocking material is such an amount that the total amount of the active hydrogen of the blocking material and the additive is from 1.0 to 1.1 equivalent of the isocyanate group of the isocyanate compound. The amount less than 1.0 equivalent of the active hydrogen produces an unreacted isocyanate group, while the amount exceeding 1.1 equivalent of the active hydrogen results in excess of blocking material, which is undesirable.

The releasing temperature of blocking material from the blocked isocyanate compound is preferably from 80 to 200° C., more preferably from 80 to 160° C., and still more preferably from 80 to 130° C.

[Polyol]

The blocked isocyanate compound in the invention is preferably an adduct of an isocyanate with a polyol.

The adduct derived from the polyol can improve storage stability of the blocked isocyanate compound. When the image formation layer containing the adduct is imagewise heated, the resulting image increases image strength, resulting in improvement of printing durability.

Examples of the polyol include a polyhydric alcohol such as propylene glycol, triethylene glycol, glycerin, trimethylol methane, trimethylol propane, pentaerythritol, neopentyl glycol, 1,6-hexylene glycol, hexamethylene glycol, xylylene glycol, sorbitol or sucrose; polyether polyol which is prepared by polymerizing the polyhydric alcohol or a polyamine with ethylene oxide and/or propylene oxide; polytetramethylene ether polyol; polycarbonate polyol; polycaprolactone polyol; polyester polyol, which is obtained by reacting the above polyhydric alcohol with polybasic acid such as adipic acid, phthalic acid, isophthalic acid, terephthalic acid, sebatic acid, fumaric acid, maleic acid, or azelaic acid; polybutadiene polyol; acrylpolyol; castor oil; a graft copolymer polyol prepared by graft polymerization of a vinyl monomer in the presence of polyether polyol or polyester polyol; and an epoxy modified polyol. Among these, a polyol having a molecular weight of from 50 to 5,000 such as propylene glycol, triethylene glycol, glycerin, trimethylol methane, trimethylol propane, pentaerythritol, neopentyl glycol, 1,6-hexylene glycol, butane diol, hexamethylene glycol, xylylene glycol, or sorbitol is preferred, and a low molecular weight polyol having a molecular weight of from 50 to 500 is especially preferred.

It is preferred that the content of the polyol is such an amount that the amount of the hydroxyl group of the polyol is from 0.1 to 0.9 equivalent of the isocyanate group of the isocyanate compound. The above range of the hydroxyl group of the polyol provides improved storage stability of the blocked isocyanate compound.

[Blocking Method]

As a blocking method of an isocyanate compound, there is, for example, a method comprising the steps of dropwise adding a blocking material to the isocyanate compound at 40 to 120° C. while stirring under an anhydrous condition and an inert gas atmosphere, and after addition, stirring the mixture solution for additional several hours. In this method, a solvent can be used, and a known catalyst such as an organometallic compound, a tertiary amine or a metal salt can be also used.

Examples of the organometallic compound include a tin catalyst such as stannous octoate, dibutyltin diacetate, or dibutyltin dilaurate; and a lead catalyst such as lead 2-ethylhexanoate. Examples of the tertiary amine include triethylamine, N,N-dimethylcyclohexylamine, triethylenediamine, N,N'-dimethylpiperazine, and diazabicyclo (2,2,2)-octane. Examples of the metal salt include cobalt naphthenate, calcium naphthenate, and lithium naphthenate. These catalysts are used in an amount of ordinarily from 0.001 to 2% by weight, and preferably from 0.01 to 1% by weight based on 100 parts by weight of isocyanate compound.

The blocked isocyanate compound in the invention, which is a reaction product of an isocyanate compound, a polyol, and a blocking material, is obtained by reacting the isocyanate compound with the polyol, and then reacting a residual isocyanate group with the blocking material or by reacting the isocyanate compound with the blocking material, and then reacting a residual isocyanate group with the polyol.

The blocked isocyanate compound in the invention has an average molecular weight of preferably from 500 to 2,000, and more preferably from 600 to 1,000. This range of the molecular weight provides good reactivity and storage stability.

[Manufacture of Aqueous Dispersion]

The blocked isocyanate compound obtained above is added to an aqueous solution containing a surfactant, and vigorously stirred in a homogenizer to obtain an aqueous dispersion of blocked isocyanate compound.

Examples of the surfactant include an anionic surfactant such as sodium dodecylbenzene sulfonate, sodium lauryl sulfate, sodium dodecyldiphenylether disulfonate, or sodium dialkyl succinate sulfonate; a nonionic surfactant such as polyoxyethylenealkyl ester or polyoxyethylenealkyl aryl ester; and an amphoteric surfactant including an alkyl betaine such as lauryl bataines or stearyl betaine and an amino acid such as lauryl β-alanine, lauryldi(aminoethyl)glycine, or octyldi(aminoethyl)glycine. These surfactant may be used singly or in combination. Among these, the nonionic surfactant is preferred.

The solid content of the aqueous dispersion of the blocked isocyanate compound is preferably from 10 to 80% by weight. The surfactant content of the aqueous dispersion is preferably from 0.01 to 20% by weight based on the solid content of the aqueous dispersion.

When an organic solvent is used in a blocking reaction of the isocyanate compound, the organic solvent can be removed from the resulting aqueous dispersion.

The image formation layer containing the isocyanate compound may contain a water-soluble material. Examples of the water-soluble material include the following compounds.

[Water-soluble Polymer]

Examples of the water-soluble material include a known water-soluble polymer, which is soluble in an aqueous solution having a pH of from 4 to 10.

Typical examples of the water-soluble polymer include polysaccharides, polyethylene oxide, polypropylene oxide, polyvinyl alcohol, polyethylene glycol (PEG), polyvinyl ether, polyacrylic acid, polyacrylic acid salt, polyacrylamide, and polyvinyl pyrrolidone.

Among these, polysaccharides, polyacrylic acid, polyacrylic acid salt, polyacrylamide, and polyvinyl pyrrolidone are preferred.

Examples of the polysaccharides include starches, celluloses, polyuronic acid and pullulan. Among these, cellulose derivatives such as a methyl cellulose salt, a carboxymethyl cellulose salt and a hydroxyethyl cellulose salt are preferred, and a sodium or ammonium salt of carboxymethyl cellulose is more preferred.

The polyacrylic acid, polyacrylic acid salt, and polyacrylamide have a molecular weight of preferably from 3,000 to 1,000,000, and more preferably from 5,000 to 500,000.

Of these, polyacrylic acid salt such as sodium polyacrylate is most preferred. The polyacrylic acid salt efficiently works as a hydrophilization agent of the hydrophilic layer, and enhance hydrophilicity of a hydrophilic layer surface which is revealed on on-press development.

[Oligosaccharides]

As the water-soluble material, oligosaccharides can be used other than the water-soluble polymers described above.

Examples of the oligosaccharides include raffinose, trehalose, maltose, galactose, sucrose, and lactose, and trehalose is especially preferred.

(Image Formation—Printing)

Image formation to prepare a printing plate utilizing a printing plate material of this invention is preferably performed by heating at the time of image exposure.

As an exposure method, exposure by a laser is specifically preferable.

After exposure, the plate material is processed by a developer to be utilized as a printing plate.

As a developer, such as an alkaline aqueous solution and a solution containing an organic solvent may be utilized.

(Alkali Agent)

An alkali agent utilized in an alkaline aqueous solution includes inorganic alkali agents such as sodium silicate, potassium silicate, ammonium silicate, sodium secondary phosphate, potassium secondary phosphate, ammonium secondary phosphate, sodium bicarbonate, potassium bicarbonate, ammonium bicarbonate, sodium carbonate, potassium carbonate, ammonium carbonate, sodium hydrogencarbonate, potassium hydrogencarbonate, ammonium hydrogencarbonate, sodium borate, potassium borate, ammonium borate, sodium hydroxide, potassium hydroxide, ammonium hydroxide and lithium hydroxide.

Further, utilized can be organic alkali agents such as monomethylamine, dimethylamine, trimethylamine, monoethylamine, diethylamine, triethylamine, mono-i-propylamine, di-i-propylamine, tri-i-propylamine, butylamine, monoethanolamine, diethanolamine, triethanolamine, mono-i-propanolamine, di-i-propanolamine, ethyleneimine, ethylenediamine and pyridine.

In addition to the above-described salt, utilized can be salt of such as sulfosalicilic acid, salicylic acid; and of sugar alcohol, saccharose and D-sorbite as non-reductive sugar.

An organic solvent utilized in an organic solvent containing solution is suitably one having a solubility in water of not more than 10 weight % and is preferably selected from those having a solubility of not more than 5 weight %.

For example, listed are 1-phenyl ethanol, 2-phenyl ethanol, 3-phenyl-1-propanol, 4-phenyl-1-butanol, 4-phenyl-2-butanol, 2-phenyl-1-butanol, 2-phenoxy ethanol, 2-benzyloxy ethanol, o-methoxy benzyl alcohol, m-methoxy benzyl alcohol, p-methoxy benzyl alcohol, benzyl alcohol, cyclohexanol, 2-methyl cyclohexanol, 2-methyl cyclohexanol, 3-methyl cyclohexanol, 4-methyl cyclohexanol, N-ethanolamine and N-phenyldiethanolamine.

In a developer, a surfactant of such as an anionic type, a cationic type, a nonionic type and an amphoteric type; a pH buffering agent, a reducing agent, organic carboxylic acid and a development stabilizer can be appropriately contained.

A development process according to this invention is preferably carried out by use of an automatic processor.

An automatic processor preferably utilized is equipped with a mechanism to automatically supply a required quantity of a replenisher into a development bath, a mechanism to effuse a developing solution exceeding a predetermined quantity, a mechanism to detect passage of a plate, a mechanism to estimate the processing area of a plate based on detection of plate passage, a mechanism to control a replenishing quantity and/or a replenishing timing of a replenisher to be supplied based on the detection of plate passage and/or the estimated processing area, a mechanism to control a temperature of a developing solution, a mechanism to detect a pH and/or conductivity of a developing solution, and a mechanism to control a replenishing quantity and/or a replenishing timing of a replenisher to be supplied based on the pH and/or conductivity of a developing solution.

Further, in the case of utilizing a process-less CTP image forming layer as an image forming layer, the laser exposed portion forms a hydrophilic image portion while the unexposed portion forms a non-image portion, and this non-image portion is removed on a printing machine to provide a printing plate, which is supplied for printing.

In the invention, exposure for image formation is preferably scanning exposure, which is carried out employing a laser which can emit light having a wavelength of infrared and/or near-infrared regions, that is, a wavelength of from 700 to 1000 nm.

As the laser, a gas laser can be used, but a semi-conductor laser, which emits light having a near-infrared region wavelength, is preferably used.

A device suitable for the scanning exposure in the invention may be any device capable of forming an image on the printing plate material according to image signals from a computer employing a semi-conductor laser.

Generally, the scanning exposures include the following processes.

(1) a process in which a plate material provided on a fixed horizontal plate is scanning exposed in two dimensions, employing one or several laser beams.

(2) a process in which the surface of a plate material provided along the inner peripheral wall of a fixed cylinder is subjected to scanning exposure in the rotational direction (in the main scanning direction) of the cylinder, employing one or several lasers located inside the cylinder, moving the lasers in the normal direction (in the sub-scanning direction) to the rotational direction of the cylinder.

(3) a process in which the surface of a plate material provided along the outer peripheral wall of a fixed cylinder is subjected to scanning exposure in the rotational direction (in the main scanning direction) of the cylinder, employing one or several lasers located inside the cylinder, moving the lasers in the normal direction (in the sub-scanning direction) to the rotational direction of the cylinder.

Removal on a press of the image formation layer at non-image portions (unexposed portions) of a printing plate material, which is mounted on the plate cylinder, can be carried out by bringing a dampening roller and an inking roller into contact with the image formation layer while rotating the plate cylinder, and can be also carried out according to various sequences such as those described below or another appropriate sequence. The supplied amount of dampening solution may be adjusted to be greater or smaller than the amount ordinarily supplied in printing, and the adjustment may be carried out stepwise or continuously.

(1) A dampening roller is brought into contact with the image formation layer of a printing plate material on the plate cylinder during one to several tens of rotations of the plate cylinder, and then an inking roller brought into contact with the image formation layer during the next one to tens of rotations of the plate cylinder. Thereafter, printing is carried out.

(2) An inking roller is brought into contact with the image formation layer of a printing plate material on the plate cylinder during one to several tens of rotations of the plate cylinder, and then a dampening roller brought into contact with the image formation layer during the next one to tens of rotations of the plate cylinder. Thereafter, printing is carried out.

(3) An inking roller and a dampening roller are brought into contact with the image formation layer of a printing plate material on the plate cylinder during one to several tens of rotations of the plate cylinder. Thereafter, printing is carried out.

(Printing)

As a printing machine utilized in a printing method according to this invention, utilized can be a planographic off set printing machine, a planographic off set rotary press and a tabular proof printing machine, which are well known in the art.

In this invention, alternation of such as a plate making condition, which depends on differences of various printing machines such as described above, can be easily made by means of a wireless tag, whereby a printed matter having stable quality can be always prepared.

(Printing Paper)

Art paper, coated paper, wood free paper and matt paper, which are generally utilized; in addition to various paper utilizing recycled pulp and various paper utilizing kenuff, which are for an environmental countermeasure, can be employed as printing paper.

In this invention, alternation of such as a plate making condition, which depends on differences of various paper such as described above, can be easily made, whereby a printed matter having stable quality can be always prepared.

EXAMPLES

In the following, this invention will be detailed with reference to examples, however, is not limited thereto. Herein, "part(s)" represents "weight part(s)" unless otherwise mentioned.

Example 1

(Preparation of Aluminum Support)

An aluminum plate (material: 1050, quality: H16) of 0.24 thick, 1003 mm wide and 800 mm long, after having been subjected to a degrease treatment at 60° C. for 1 minute in a 5% caustic soda aqueous solution, was subjected to an electrolytic etching treatment, under a condition of a temperature of 25° C., a current density of 60 A/dm$^2$ and a processing time of 30 seconds, in a 0.5 mol/l hydrochloric acid aqueous solution.

Next, the aluminum plate, after having been subjected to a desmut treatment at 60° C. for 10 seconds in a 5% caustic soda aqueous solution, was subjected to an anodic oxidation treatment under a condition of a temperature of 20° C., a current density of 3 A/dm$^2$ and a processing time of 1 minute, in a 20% sulfuric acid solution. Further, the aluminum plate was subjected to a hot water sealing treatment with hot water of 30° C. for 20 seconds, whereby an aluminum support as a support for a planographic printing plate material was prepared.

An image forming layer coating solution having the following composition was coated on the aforesaid aluminum support by use of an extrusion coater so as to make a dry layer thickness of 2 g/m$^2$, followed by being dried in the first drying at 60° C. for 20 seconds and then in the second drying at 100° C. for 40 seconds, whereby a printing plate material was prepared.

(Image Forming Layer Coating Composition)

| | |
|---|---|
| Binder (binder 1 described below) | 20 parts |
| Novolak resin (polycondensation novolak resin of phenol, m-, p-mixed (6/4) cresol and formaldehyde (a ratio of phenol to cresol is 6/4) (all are based on a weight ratio) | 40 parts |
| Acid-induced decomposing compound (acid-induced decomposing compound A described below) | 20 parts |
| Photo-induced acid generator A (2-trichloromethyl-5-[β-(2-benzofuryl)vinyl]-1,3,4-oxadiazol) | 5 parts |
| Infrared absorbent (following IR17) | 2 parts |
| Propylene glycol monomethylether | 1000 parts |

(Synthesis of Acid-induced Decomposing Compound)

1,1-dimethoxy cyclohexane (0.5 mol), phenyl cellosolve (1.0 mol) and 80 mg of p-toluene sulfonate were reacted at 100° C. for 1 hour while being stirred, and the temperature was gradually raised up to 150° C. followed by a reaction at 150° C. for 4 hours.

Ethanol generated by the reaction was meanwhile eliminated by distillation. The system, after having been cooled, was added with 500 ml of tetrahydrofuran and 2.5 g of potassium carbonate unhydride, and was stirred and filtered.

A solvent was removed from the filtrate under reduced pressure, followed by elimination of a low boiling point component under a highly reduced pressure, whereby following acid-induced decomposing compound A, which is viscous and oily, was prepared.

[Chemical Structure 1]

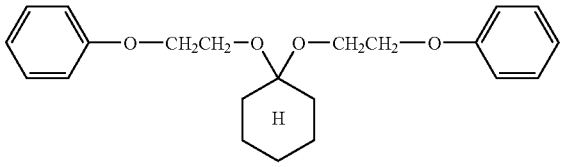

Acid-induced decomposing compound A

[Chemical Structure 2]

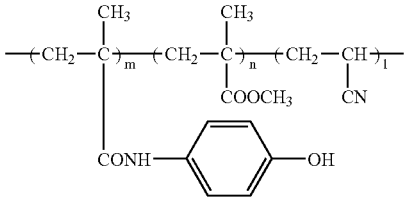

Binder 1

(Mw = 22000 Mw/Mn = 1.5 m:n:l = 30:40:30)

[Chemical Structure 3]

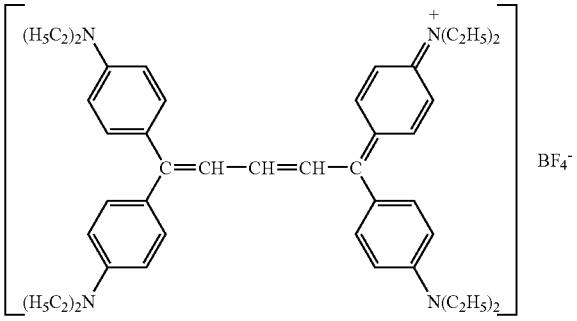

IR17

Next, this printing plate material was cut into a rectangular form of 730 mm wide and 600 mm long and 1000 sheets of the printing plate materials having this size were prepared.

With respect to each of these 1000 sheets, a hole of 3 cm square was made at the center of the holding end portion in the longitudinal direction (the longitudinal direction at the time of being mounted on a printing machine) with keeping a width of 5 mm from the aluminum plate end.

Next, the RF-ID described below was adhered with a double coated tape on a transparent PET film having a thickness of 175 μm and adhered with an adhesive so as to be arranged at the center of the 3 cm square (the plane view and the cross sectional view are shown in FIG. 2). The following RF-ID chip (manufactured by Hitachi Maxell, Ltd.) was utilized.

Protocol: original method

Carrier frequency: 13.56 MHz

Memory capacity: 1 Mbit

Data transfer rate: 26.48 kbps

Successively, the first sheet and the 1000th sheet among the above 1000 sheets were extracted, and subjected to exposure and development treatments under the following condition to examine sensitivity data.

(Image Formation)

Exposure Condition

Setter: Trendsetter 400 Quantum (manufactured by Creo Corp.)

Exposure: 2400 dpi (dpi represents a dot number per 2.54 cm), 9.3 W and 185 rpm (a rotation number of the drum) were employed.

(Development)

Automatic processor: InterPlater 85HD (produced by Glunz & Jensen Corp.)

Developing solution A:

| | |
|---|---|
| Potassium silicate | 100.0 parts |
| Potassium hydroxide | 24.5 parts |
| Caprylic acid | 0.2 parts |
| Maleic acid | 2.0 parts |
| EDTA (ethylenediaminetetraacetatic acid) | 0.3 parts |
| Water | 1840 parts |

Development temperature: 25° C.±1° C.

Development time: 20 seconds±1 second (Finisher)

GW-3 (manufactured by Mitsubishi Chemical Corp.)

(Sensitivity)

The minimum quantity of energy at which the exposed portion of an image forming layer is completely removed after development was measured to be defined as an index of sensitivity.

A sensitivity was 79 mj/cm$^2$ for the first sheet and 81 mj/cm$^2$ for the last sheet; and the mean value was 80 mj/cm$^2$.

(Data Writing on Wireless Tag (RF-ID))

By use of the following system as a reader/writer, a sensitivity data and a manufactured date were recorded on the rest 1998 sheets of printing plate materials. Recording was possible from a place of 2 m distant. Reader/writer controller: ME-L1002 (manufactured by Hitachi Maxell Corp.), reader/writer transceiver/receiver: ME-L4001 (manufactured by Hitachi Maxell Corp.), and antenna coil: ME-C1001 (manufactured by Hitachi Maxell Corp.), are utilized by being connected to a personal computer.

Next, manufacturing, exposure, development and inspection (sensitivity measurement) of the printing plate material above described were repeated 8 times over 1 month to obtain a data of 8 lots.

Each sensitivity data is shown in table 1.

TABLE 1

| Lot No. | Sensitivity (mj/cm$^2$) |
|---|---|
| 1 | 80 |
| 2 | 85 |
| 3 | 92 |
| 4 | 85 |
| 5 | 83 |
| 6 | 75 |
| 7 | 68 |
| 8 | 72 |

These sensitivity data were converted to data substituted by a rotation number of a corresponding setter and written on an RF-ID.

Successively, a part of these lots of a plate was stored in a conditioning room (dry thermo: <DT storage>) (50° C., relative humidity of 2-3%) and 1 sheet per two days was extracted to perform the above-described exposure and development, whereby sensitivity was measured.

Further, the mean value of accelerated aging data of 8 lots was determined and a correlation curve between aging days and sensitivity was calculated when DT-1 is set to 1 week, which was held on an RF-ID.

In addition to this, relation of aging time and development time to give a constant sensitivity was determined by varying development time, which was recorded on an RF-ID.

A development time and an exposure time (a rotation number of a setter) were determined as a development time and an exposure time (a rotation number of a setter) to give the best dot for dot reproduction.

A printing material, which has been manufactured in the above manner and on an RF-ID of which such as a sensitivity information, a manufactured date and an aging change information were written, was subjected to plate making and printing process under the following condition over approximately half a year.

Herein, sensitivity information and aging information were read before exposure of the printing plate material.

(Image Formation)

Exposure Condition

Setter: Trendsetter 400 Quantum (Creo Corp.)

Exposure: 2400 dpi (dpi represents a dot number per 2.54 cm), 9.3 W, (a rotation number was controlled by appropriately being changed based on a calculated value with reference to data of sensitivity information held on an RF-ID)

(Development Process)

Automatic processor: InterPlater 85HD (produced by Glunz & Jensen Corp.)

Developing solution A:

| | |
|---|---|
| Potassium silicate | 100.0 parts |
| Potassium hydroxide | 24.5 parts |
| Caprylic acid | 0.2 parts |
| Maleic acid | 2.0 parts |
| EDTA (ethylenediaminetetraacetate) | 0.3 parts |
| Water | 1840 parts |

Finisher:

GW-3 (manufactured by Mitsubishi Chemical Corp.)

Development temperature: 25° C.±1° C.

The development time was controlled by appropriately being varied based on a calculated value with reference to information data of aging after manufacturing and exposure condition information held on an RF-ID.

Small dot reproduction (200 lpi, reproduction of small dots equivalent to 3% and 5%) and reproduction in a shadow portion (200 lpi, shadow reproduction equivalent to 97% and 95%) were read on a plate, which were shown in table 2.

Herein, as comparison, data of a printing plate, which had been exposed under an ordinary condition without reading out the RF-ID information, was also shown in table 2.

An exposure time at exposure and a development time at developing were changed depending on data read out from an RF-ID; however, the values at that time were visually read out and shown in table 2 together with aging days.

Thereafter, the plate described above was used as a printing plate. Dot for dot reproduction (small dot/shadow portion) on the printed matter was quite same as the visual evaluation results after plate making.

Further, a printing plate of each lot was able to print up to 300,000 sheets.

(Printing Condition)

Printing Machine: DAIYA 1F-1 (produced by Mitsubishi Heavy Industries, Ltd.)

Paper: Coated paper (regenerated pulp content of 20%, manufactured by Hokuetsu Paper Making Co., Ltd.)

Blanket: SR100 (SRI Hybrid Co., Ltd.)

Printing ink: Soybean oil ink, Naturalith 100 (Y, M, C, K) (manufactured by Dainippon Ink & Chemicals Inc.)

Dampening solution: H solution SG-51, concentration of 1.5% (manufactured by Tokyo Ink Co., Ltd.)

Printing speed: 4000 sheets/hour

The results are shown in table 2. It is clear from table 2 that a printed matter exhibiting stable dot quality can be always obtained by a printing plate material and a plate making method of this invention.

TABLE 2

| Lot of printing plate material | *2 | Exposure rotation number (rpm) | RF-ID information feedback | Development time (sec) | Small dot reproduction 200 lpi 5% (*1) | Small dot reproduction 200 lpi 3% (*1) | Shadow reproduction 200 lpi 95% | Shadow reproduction 200 lpi 97% | Remarks |
|---|---|---|---|---|---|---|---|---|---|
| 1 | 1 | 185 | ON | 30 | A | A | A | A | Inv. |
| 2 | 1 | 178 | ON | 30 | A | A | A | A | Inv. |
| 3 | 1 | 159 | ON | 30 | A | A | A | A | Inv. |
| 4 | 1 | 178 | ON | 30 | A | A | A | A | Inv. |
| 5 | 1 | 180 | ON | 30 | A | A | A | A | Inv. |
| 6 | 1 | 203 | ON | 30 | A | A | A | A | Inv. |
| 7 | 1 | 223 | ON | 30 | A | A | A | A | Inv. |
| 8 | 1 | 220 | ON | 30 | A | A | A | A | Inv. |
| 1 | 7 | 185 | ON | 28 | A | A | A | A | Inv. |
| 1 | 60 | 182 | ON | 33 | A | A | A | A | Inv. |
| 1 | 120 | 175 | ON | 40 | A | A | A | A | Inv. |
| 1 | 180 | 170 | ON | 45 | A | A | A | A | Inv. |
| 3 | 7 | 160 | ON | 30 | A | A | A | A | Inv. |
| 3 | 60 | 155 | ON | 35 | A | A | A | A | Inv. |
| 3 | 120 | 150 | ON | 40 | A | A | A | A | Inv. |
| 3 | 180 | 147 | ON | 48 | A | A | A | A | Inv. |
| 7 | 7 | 222 | ON | 30 | A | A | A | A | Inv. |
| 7 | 60 | 219 | ON | 35 | A | A | A | A | Inv. |
| 7 | 120 | 200 | ON | 39 | A | A | A | A | Inv. |
| 7 | 180 | 190 | ON | 41 | A | A | A | A | Inv. |
| 1 | 1 | 185 | OFF | 30 | A | A | A | A | Comp. |

TABLE 2-continued

| Lot of printing plate material | *2 | Exposure rotation number (rpm) | RF-ID information feedback | Development time (sec) | Small dot reproduction 200 lpi 5% (*1) | Small dot reproduction 200 lpi 3% (*1) | Shadow reproduction 200 lpi 95% | Shadow reproduction 200 lpi 97% | Remarks |
|---|---|---|---|---|---|---|---|---|---|
| 2 | 1 | 185 | OFF | 30 | B | B | C | D | Comp. |
| 3 | 1 | 185 | OFF | 30 | B | B | D | D | Comp. |
| 4 | 1 | 185 | OFF | 30 | B | B | C | D | Comp. |
| 5 | 1 | 185 | OFF | 30 | B | B | B | C | Comp. |
| 6 | 1 | 185 | OFF | 30 | C | D | B | B | Comp. |
| 7 | 1 | 185 | OFF | 30 | D | D | B | B | Comp. |
| 8 | 1 | 185 | OFF | 30 | C | D | B | B | Comp. |
| 1 | 7 | 185 | OFF | 30 | B | D | B | B | Comp. |
| 1 | 60 | 185 | OFF | 30 | B | B | B | C | Comp. |
| 1 | 120 | 185 | OFF | 30 | B | B | C | D | Comp. |
| 1 | 180 | 185 | OFF | 30 | A | B | D | D | Comp. |
| 3 | 7 | 185 | OFF | 30 | B | B | C | D | Comp. |
| 3 | 60 | 185 | OFF | 30 | B | B | D | D | Comp. |
| 3 | 120 | 185 | OFF | 30 | B | B | D | E | Comp. |
| 3 | 180 | 185 | OFF | 30 | A | B | D | E | Comp. |
| 7 | 7 | 185 | OFF | 30 | C | D | B | B | Comp. |
| 7 | 60 | 185 | OFF | 30 | C | D | B | B | Comp. |
| 7 | 120 | 185 | OFF | 30 | D | D | B | B | Comp. |
| 7 | 180 | 185 | OFF | 30 | D | D | C | C | Comp. |

*1 Visual evaluation by use of a loupe,
*2: Aging days from manufacture to use,
Inv.: Invention,
Comp.: Comparison
*1 Visual evaluation by use of a loupe
A: Dot for dot reproduction is uniform and good.
B: Dot for dot reproduction is good.
C: Deformation is partly observed.
D: Missing and fill-in are partly observed.
E: Dot for dot reproduction is poor.

Further, similar results were obtained when preparation—printing of a printing plate material were performed similarly to the above-described manner except a wireless tag was mounted in the forms shown in FIGS. 4 and 7.

As an insulator, polypropylene was utilized and it is adhered on an aluminum support with an adhesive.

A printing plate with a wireless tag was possible to be smoothly mounted on a printing machine under the same condition as that of a plate without a wireless tag.

Example 2

Next, similar evaluation was performed by changing an adhesion method of an RF-ID on a printing plate into the following 2 types.

(Adhesion of Wireless Tag (RF-ID) in Protrusion Form)

A PET film (3 cm×6 cm) having a thickness of 175 μm was pasted on the back surface of a photosensitive planographic printing plate, which had been cut (730 mm wide, 600 mm long) after coating and drying similarly to the above-described manner, at the center portion along the extended longitudinal direction, and an RF-ID similar to one described above was adhered with a double coated tape on the center of a protruded portion (3 cm×3 cm) (mounted in a form shown in FIG. 4).

Thereafter, by utilizing an RF-ID adhered on the extruded potion as described above, writing/reading was carried out and plate making and printing were performed over half a year.

The plate making condition was possible to be controlled similarly to the above-described manner, except that time required to be mounted on a printing machine at the time of printing was longer than the former case, whereby a similar result as described in table 2 was obtained.

(Adhesion of Wireless Tag (RF-ID) in Direct Pasting)

The following RF-ID was utilized, being sandwiched between a synthetic rubber film (2 cm×2 cm) having a thickness of 175 μm and an aluminum plate, and was pasted up with an adhesive tape.

The pasting position was on the back side of the center of a holding end portion (being mounted in a form shown in FIG. 5).

(RF-ID)

Accuwave OMH-4230 (manufactured by Dainippon Printing Co., Ltd.)

Thereafter, by utilizing the RF-ID similarly to the above-described manner, writing/reading was carried out to perform plate making and printing over half a year, in a similar manner. The plate making condition was possible to be controlled similarly to the above-described manner, except that recording and read of information data had to be performed at a distance of approximately 5 cm, whereby a similar result as described in table 2 was obtained.

Example 3

(Feedback to Printing Condition)

Next, utilizing printing plate material lot 1, plate making was performed in a similar manner to example 1 except the following.

That is, exposure condition 2 (a mark data in which a rotation number was set slower than an ordinary condition by 20%) was recorded on a wireless tag (an RF-ID) by a writer immediately before laser exposure and exposure was performed under this condition.

When a mark data was read utilizing a program, which had been set based on printing paper and an exposure condition in advance, by use of an RF-ID reader equipped on a printing machine, a 2-steps feeding paper supply of wood free paper and coated paper was automatically changed into wood free paper to perform printing.

The printed dot image portion on a printed matter was observed and the result was shown in table 3. As a comparison, the case of an exposure condition being not changed was shown.

The results are shown in table 3. It is clear from table 3 that a printed matter exhibiting stable dot quality can be always obtained by a printing plate material and a plate making method of this invention.

TABLE 3

| Lot of printing plate material | Aging days from manufacture to use | Exposure rotation number (rpm) | *2 | Printing paper | Small dot reproduction 200 lpi 5% (*1) | Small dot reproduction 200 lpi 3% (*1) | Shadow reproduction 200 lpi 95% (*1) | Shadow reproduction 200 lpi 97% (*1) | remarks |
|---|---|---|---|---|---|---|---|---|---|
| 1 | 60 | 185 | ON | Coated paper | A | A | A | A | Inv. |
| 1 | 60 | 148 | ON | Wood free paper | A | A | A | A | Inv. |
| 1 | 60 | 185 | OFF | Wood free paper | C | C | D | E | Comp. |

*1 Visual evaluation by use of a loupe,
*2: RF-ID information feed back to printing
Inv.: Invention,
Comp.: Comparison,
*1 Visual evaluation by use of a loupe
A: Dot for dot reproduction is uniform and good.
B: Dot for dot reproduction is good.
C: Deformation is partly observed.
D: Missing and fill-in are partly observed.
E: Dot for dot reproduction is poor.

The above-described plate was utilized as a printing plate thereafter. Dot for dot reproduction (small dot portion/shadow portion) on a printed matter was quite same as visual evaluation results after plate making.

(Printing Condition)

Printing Machine: DAIYA 1F-1 (produced by Mitsubishi Heavy Industries, Ltd.)

Paper: Coated paper (regenerated pulp content of 20%, manufactured by Hokuetsu Paper Making Co., Ltd.)

Blanket: SR100 (SRI Hybrid Co., Ltd.)

Printing ink: Soybean oil ink, Naturalith 100 (Y, M, C, K) (manufactured by Dainippon Ink & Chemicals Inc.)

Dampening solution: H solution SG-51, concentration of 1.5% (manufactured by Tokyo Ink Co., Ltd.)

Printing speed: 4000 sheets/hour

Example 4 (Process-less CTP)

(Preparation of Aluminum Support)

An aluminum plate (material: 1050, quality: H16) of 0.24 mm thick, after having been immersed in a 1 weight % sodium hydroxide aqueous solution at 50° C. to perform a dissolution treatment so as to make a dissolution amount of 2 g/m$^2$ followed by being washed, was immersed in a 0.1 weight % hydrochloric acid aqueous solution at 25° C. for 30 seconds to be neutralized and then washed.

Next, this aluminum plate was subjected to an electrolytic roughening treatment under a condition of a peak current density of 50 A/dm$^2$ by use of alternating current of a sine wave, with an electrolytic solution containing 10 g/L of hydrochloric acid and 0.5 g/L of aluminum.

Distance between an electrode and the sample surface at this treatment was set to 10 mm. The electrolytic roughening treatment was carried out by dividing into 12 times and a process quantity of electricity (at anode time) per one time was 40 C/dm$^2$ to make the total process quantity of electricity (at anode time) of 480 C/dm$^2$. Further, a pausing time of 4 seconds was provided between each roughening treatment.

After the electrolytic roughening, the plate was immersed in a 1 weight % sodium hydroxide aqueous solution kept at 50° C. to be etched so as to make a dissolution amount including smut on the roughened surface of 2 g/m$^2$, followed by being washed, and then immersed in a 10% sulfuric acid aqueous solution kept at 25° C. for 10 seconds to be neutralized, followed by being washed. Successively, the plate was subjected to an anodic oxidation treatment so as to make a quantity of electricity of 150 C/dm$^2$ under a condition of a constant voltage of 20 V, and was further washed.

Next, after the surface water was squeezed, the plate was immersed in a 0.5 weight % sodium trisilicate aqueous solution kept at 70° C. for 30 seconds, and was washed and dried at 80° C. for 5 minutes, whereby an aluminum support was prepared.

(Image Forming Layer)

(Preparation of Water Dispersion of Blocked Isocyanate Compound)

Blocked isocyanate of an organic solvent system, in which a trimethylol propane adduct of trilene diisocyanate had been blocked by methylethyl ketoxime (solid content of 55 weight %, solvent: a mixed solvent of ethyl acetate and MIBK) of 364 weight parts was dissolved in 136 weight parts of toluene.

Next, after this solution was added with 20 weight parts of polyoxyethylene alkylphenylether as a dispersant, further 300 weight parts of pure water was gradually added while stirring, and the mixed solution was strongly stirred by use of a homogenizer to disperse an oil phase in a water phase. Successively, organic solvents were removed under reduced pressure to prepare a blocked isocyanate compound water dispersion having a solid content of 40 weight %.

(Preparation of Image Forming Layer Coating Solution)

The materials of each composition in the following table were sufficiently mixed and stirred, followed by being filtered, whereby an image forming layer coating solution having a solid content of 5 weight % was prepared.

Image Forming Layer Coating Solution Composition (Numbers in the Table Without Unit Definition Represent Weight Part(s).)

TABLE 4

| | Material | 1 |
|---|---|---|
| Blocked isocyanate compound | Prepared blocked isocyanate compound water dispersion (solid content: 40 weight %) Blocked isocyanate compound water dispersion: WB-700 (manufactured by Mitsui Takeda Chemical Co., Ltd., isocyanate compound; trimethylolpropane adduct of TDI, Blocking agent: Oxime system, dissociation temperature: 120° C., solid content of 44 weight %) | 10.63 |
| Water-soluble material | Torehalose aqueous solution (product name: Toreha, melting point of 97° C., an aqueous solution having a solid content of 10 weight %, manufactured by Hayashi Bussiness Co., Ltd.) | 5.00 |
| Thermoplastic micro-particles | Copolymer emulsion of acrylonitrile•styrene•alkyl acrylate•methacrylic acid: Yodosol GD87B (manufactured by Nippon NSC Co., Ltd., mean particle size of 90 nm, Tg of 60° C., solid content of 45 weight %) | |
| Infrared absorbent | An aqueous solution (solid content: 1 weight %) of water-solublr dye (IR-1) | 25.00 |
| | Pure water | 59.37 |

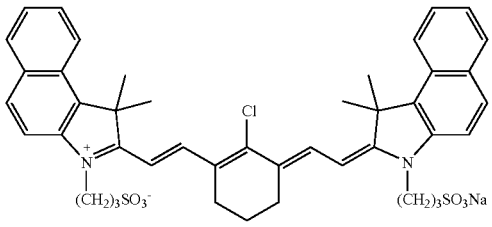

[Chemical Structure 4]
[IR-1]

Preparation of Printing Plate

With a combination of the aforesaid substrate and the image forming layer coating solution, an image forming layer was coated on the substrate so as to make a dry coating amount of 0.6 g/m$^2$ to prepare a printing plate material. Drying was performed under a condition of 55° C. for 3 minutes, and then aging at 60° C. for 24 hours was performed.

(Direct Adhesion of Wireless Tag (RF-ID))

Similarly to the above-described manner, the following wireless tag was pasted up at the center of PET film (3 cm×3 cm) having a thickness of 175 μm, and the wireless tag was pasted up on the aforesaid aluminum support including an insulating adhesive layer so as to be sandwiched between PET film and the aluminum support (being mounted in a form shown in FIG. 1).

The pasting up position was at the center portion of the holding end portion and on the backside of a printing plate material.

(Wireless Tag (RF-ID))

Accuwave OMH-4230 (manufactured by Dainippon Printing Co., Ltd.)

(Sensitivity Evaluation)

This manufacturing was repeated 4 times similar to the case of a thermal CTP of example 1.

Successively, after exposure similar to the aforesaid thermal CTP had been performed, development on a printing machine and printing were performed to determine sensitivity information shown in table 5.

(Sensitivity)

An exposure quantity to reproduce the original dot data of 95% as 94-95% on a printed matter after development on a machine was defined as sensitivity.

TABLE 5

| Lot No. | Sensitivity (mj/cm$^2$) |
|---|---|
| 1 | 110 |
| 2 | 115 |
| 3 | 125 |
| 4 | 88 |

(Method of Image Formation—Printing)

Sensitivity information data and manufactured date information date were recorded on an RF-ID, in a similar manner to example 1.

Data of accelerated aging condition information was measured and recorded on an RF-ID, in a similar manner to example 1.

Printing was performed by use of Daiya 1F-1 (manufactured by Mitsubishi Heavy Industries, Ltd.) as a printing machine, and utilizing coated paper, 2 weight % of Astromark 3 (manufactured by Nikken Chemical Laboratory Co., Ltd.) as a dampening solution and Toyo King High Unity M Magenta (manufactured by Toyo Ink Mfg. Co., Ltd.) as ink.

A printing plate after exposure was mounted on a plate drum as it is, a number of wasted paper sheets required to start printing being counted by employing a printing condition and an initial printing sequence similar to those in the case of a PS plate, and dot for dot reproduction of a printed material at 100th sheets was evaluated.

At the time of printing, data of sensitivity information, manufactured date information, accelerated aging condition information and printing machine information (quantity of a dampening solution) were referred to for calculation, whereby printing was performed by controlling quantity of a dampening solution.

The results are shown in table 6. It is clear from table 6 that a printed matter having stable quality can be always obtained by a printing method of this invention.

TABLE 6

| Lot of printing plate material | Aging days from manufacture to use | Exposure rotation number (rpm) | RF-ID information feedback | Water quantity at the time of development on a machine (*2) | Wasted number of sheets at start in the case of development on a machine | Small dot reproduction 200 lpi 3% (*1) | Shadow reproduction 200 lpi 97% (*1) | Remarks |
|---|---|---|---|---|---|---|---|---|
| 1 | 1 | 170 | ON | 0 | 14 | A | A | Inv. |
| 2 | 1 | 160 | ON | 0 | 14 | A | A | Inv. |
| 3 | 1 | 151 | ON | 0 | 13 | A | A | Inv. |
| 4 | 1 | 181 | ON | 0 | 15 | A | A | Inv. |
| 1 | 7 | 169 | ON | 0 | 14 | A | A | Inv. |
| 1 | 60 | 172 | ON | +5 | 14 | A | A | Inv. |
| 1 | 120 | 166 | ON | +21 | 14 | A | A | Inv. |
| 1 | 180 | 170 | ON | +25 | 15 | A | A | Inv. |
| 2 | 7 | 164 | ON | +2 | 13 | A | A | Inv. |
| 2 | 60 | 151 | ON | +5 | 14 | A | A | Inv. |
| 2 | 120 | 148 | ON | +23 | 15 | A | A | Inv. |
| 2 | 180 | 141 | ON | +27 | 14 | A | A | Inv. |
| 3 | 7 | 159 | ON | +4 | 13 | A | A | Inv. |
| 3 | 60 | 155 | ON | +15 | 14 | A | A | Inv. |
| 3 | 120 | 145 | ON | +27 | 15 | A | A | Inv. |
| 3 | 180 | 137 | ON | +31 | 15 | A | A | Inv. |
| 4 | 7 | 190 | ON | 0 | 13 | A | A | Inv. |
| 4 | 60 | 187 | ON | +5 | 14 | A | A | Inv. |
| 4 | 120 | 180 | ON | +21 | 14 | A | A | Inv. |
| 4 | 180 | 168 | ON | +26 | 15 | A | A | Inv. |
| 1 | 1 | 170 | OFF | 0 | 15 | A | A | Comp. |
| 2 | 1 | 170 | OFF | 0 | 17 | C | C | Comp. |
| 3 | 1 | 170 | OFF | 0 | 19 | D | C | Comp. |
| 4 | 1 | 170 | OFF | 0 | 18 | C | D | Comp. |
| 1 | 7 | 170 | OFF | 0 | 15 | C | C | Comp. |
| 1 | 60 | 170 | OFF | 0 | 17 | C | C | Comp. |
| 1 | 120 | 170 | OFF | 0 | 22 | C | D | Comp. |
| 1 | 180 | 170 | OFF | 0 | 30 | C | E | Comp. |
| 2 | 7 | 170 | OFF | 0 | 20 | C | B | Comp. |
| 2 | 60 | 170 | OFF | 0 | 22 | C | B | Comp. |
| 2 | 120 | 170 | OFF | 0 | 28 | C | D | Comp. |
| 2 | 180 | 170 | OFF | 0 | 33 | C | E | Comp. |
| 3 | 7 | 170 | OFF | 0 | 20 | D | B | Comp. |
| 3 | 60 | 170 | OFF | 0 | 22 | D | C | Comp. |
| 3 | 120 | 170 | OFF | 0 | 35 | C | D | Comp. |
| 3 | 180 | 170 | OFF | 0 | 36 | C | E | Comp. |
| 4 | 7 | 170 | OFF | 0 | 20 | C | B | Comp. |
| 4 | 60 | 170 | OFF | 0 | 28 | C | B | Comp. |
| 4 | 120 | 170 | OFF | 0 | 36 | C | D | Comp. |
| 4 | 180 | 170 | OFF | 0 | 39 | C | E | Comp. |

*1 Same as described above,
*2: Water quantity of development on a machine represents water quantity at the start of printing (relative value of a water quantity gage, for example, +10 means a water quantity larger by 10%)
Inv.: Invention,
Comp.: Comparison
*1 Same as described above,
*2: Water quantity of development on a machine represents water quantity at the start of printing (relative value of a water quantity gage, for example, +10 means a water quantity larger by 10%)

Example 5

500 sheets having an excellent coating behavior were selected among the printing plate materials of example 1, which were mounted without an interleaf on a pallet of a lateral type, which was shown in FIG. 8, and packed with moisture-tight paper.

Herein, as a mounting table, utilized one made of stainless steel.

Successively, after a SBR rubber plate of 5 cm square and 3 mm thick was adhered on the top of a wood plate with a double-coated tape, the aforesaid RF-ID was adhered on the center thereof, and sensitivity information (a power and a rotation index of a setter) and manufactured date information were written therein under the following writing condition.

At the time of image formation, in a similar manner to example 1, such as development time was appropriately changed for control depending on the value calculated referring to data of aging information after manufacturing and exposure condition information, which were held on an RF-ID.

As a result, it has been proved that a printed matter exhibiting stable quality can be always obtained similar to example 1.

What is claimed is:

1. A planographic printing plate material comprising an aluminum support, an image forming layer provided on a part of the aluminum support for forming an image in response to imagewise exposure; and a wireless IC rag provided on a part of the aluminum support;

wherein the wireless IC tag contains sensitivity information of the image forming layer and in order to make the planographic printing material the following steps are performed:

measuring the sensitivity of the image forming layer at the time of manufacture so as to obtain sensitivity information of the image forming layer; and recording the obtained sensitivity information in the wireless IC tag.

2. The planographic printing plate of claim 1, wherein a manufactured date of the planographic printing plate material and aging information of the sensitivity of the image forming layer are recorded in the wireless IC tag.

3. The planographic printing plate of claim 2, wherein a correlation curve between aging days and the sensitivity is recorded in the wireless IC tag.

4. A plate-making method comprising:

imagewise exposing the printing plate material described in claim 1 by controlling imagewise exposure conditions based on the data of information concerning the planographic printing plate material.

5. The plate-making method described in claim 4, wherein information concerning the printing plate material is information of sensitivity.

6. A plate-making method comprising:

developing processing the planographic printing plate material described in claim 1 by controlling developing processing conditions based on the data of information concerning the printing plate material.

7. The plate-making method according to claim 6, wherein the information concerning the printing plate material includes aging information after manufacturing the planographic printing plate material and information of exposure conditions.

8. A printing method comprising steps of:

conducting imagewise exposure and developing the planographic printing plate material described in claim 1, and conducting printing by controlling printing conditions based on data of information concerning the planographic printing plate material.

9. The printing method according to claim 8, wherein the information concerning the planographic printing plate material includes information of exposure conditions and information of photographic processing conditions.

10. A method for producing a planographic printing plate material comprising an aluminum support, an image forming layer provided on a part of the aluminum support for forming an image in response to imagewise exposure; and a wireless IC tag provided on a part of the aluminum support, wherein the wireless IC tag contains sensitivity information of the image forming layer, said method comprising:

measuring the sensitivity of the image forming layer at the time of manufacture so as to obtain sensitivity information of the image forming layer; and recording the obtained sensitivity information in the wireless IC tag.

11. The method of claim 10, wherein a manufactured date of the planographic printing plate material and aging information of the sensitivity of the image forming layer are recorded in the wireless IC tag.

12. The method of claim 11, wherein a correlation curve between aging days and the sensitivity is recorded in the wireless IC tag.

* * * * *